US008371580B2

(12) United States Patent
Nireki

(10) Patent No.: US 8,371,580 B2
(45) Date of Patent: Feb. 12, 2013

(54) PAPER SHEET TREATING APPARATUS WITH UPSTREAM SIDE TOUCHING FACES

(75) Inventor: Takao Nireki, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 294 days.

(21) Appl. No.: 12/812,416

(22) PCT Filed: Jan. 9, 2009

(86) PCT No.: PCT/JP2009/050259

§ 371 (c)(1),
(2), (4) Date: Jul. 9, 2010

(87) PCT Pub. No.: WO2009/088090

PCT Pub. Date: Jul. 16, 2009

(65) Prior Publication Data

US 2010/0289211 A1 Nov. 18, 2010

(30) Foreign Application Priority Data

Jan. 11, 2008 (JP) ..... 2008-004316

(51) Int. Cl.
*B65H 9/04* (2006.01)

(52) U.S. Cl. ..... 271/245; 271/250

(58) Field of Classification Search ..... 271/245, 271/250, 253, 254

See application file for complete search history.

(56) References Cited

U.S. PATENT DOCUMENTS

| | | | | |
|---|---|---|---|---|
| 4,657,239 | A | 4/1987 | Ikesue et al. | |
| 6,296,248 | B1 | 10/2001 | Tanaka | |
| 7,635,123 | B2 * | 12/2009 | Watanabe et al. | 271/245 |
| 7,762,547 | B2 * | 7/2010 | Nireki | 271/240 |
| 2005/0045449 | A1 * | 3/2005 | Nago et al. | 194/207 |
| 2009/0057094 | A1 * | 3/2009 | Nireki | 194/206 |

FOREIGN PATENT DOCUMENTS

| | | |
|---|---|---|
| EP | 1 013 587 A2 | 6/2000 |
| JP | 2501890 | 5/1996 |
| JP | 2000 185846 | 7/2000 |
| JP | 2002 279487 | 9/2002 |

OTHER PUBLICATIONS

Office Action issued Jan. 29, 2012, in Chinese Patent Application No. 200980102013.7 with English translation.

* cited by examiner

*Primary Examiner* — Gerald McClain

(74) *Attorney, Agent, or Firm* — Edwards Wildman Palmer LLP

(57) ABSTRACT

A paper sheet processing apparatus capable of correcting an inclination to a traveling direction when a paper sheet is inserted into an insertion slot. The paper sheet processing apparatus includes a pair of movable pieces capable of being moved toward a center direction of the traveling route through which the paper sheet is conveyed by a motor. The pair of movable pieces are moved toward the center direction of the traveling route by a driving source such that the distance between one movable piece and the other movable piece becomes shorter than a width of the bill and corrects the inclination of the bill to the traveling direction by regulating side edges of the bill to be conveyed before the bill reaches the movable pieces.

6 Claims, 21 Drawing Sheets

PAPER SHEET TREATING APPARATUS WITH UPSTREAM SIDE TOUCHING FACES

FIELD OF THE INVENTION

The present invention relates to a paper sheet processing apparatus (or paper sheet treating apparatus) in which bills, cards, coupon tickets, and so on (hereafter collectively referred to as "paper sheet") are prevented from being jammed at an insertion slot thereof.

BACKGROUND ART

In general, a bill processing apparatus, which is one of the embodiments of the paper sheet processing apparatus, is incorporated into a service device such as a game medium rental machine installed in a game hall, a vending machine or a ticket-vending machine installed in a public space, or the like which identifies the validity of a bill inserted from a bill insertion slot by a user and provides various types of products and services in accordance with a value of the bill having been judged as valid. Such a bill processing apparatus comprises a bill conveyance mechanism that conveys a bill inserted into a bill insertion slot, operation equipments such as a bill identification part that conducts validity judgment (or also referred to as authenticity judgment) whether the bill to be conveyed is valid or not, etc., and control means which drives and controls such operation equipments.

Here, the bill identification part is configured to read a bill in a traveling state by an identification sensor such as a line sensor, to compare its output with legitimate data having been stored in advance, and to judge the validity. In order to read all bills at a uniform level, it is required to convey the bills in an exact state that the bills are not allowed to pass obliquely (to correct inclination of the bills to a traveling direction, hereinafter being referred to as "skew correction"). Further, since widths of bills may be different by the kind of the bills, it is necessary to feed a bill into the bill identification part as the bill is exactly and accurately positioned (e.g., centering and the like).

As a bill processing apparatus having a skew correction mechanism that positions a bill in an exact state with respect to the bill identification part as described above, such a configuration is disclosed, for example, in Patent Document 1 and has been known. In this known technology, a pair of movable pieces, each of which has a cross section of a general U-shape, is provided on a bill traveling route so as to regulate both side edges of a bill to be conveyed, and an alignment motor is driven at a stage that the bill is located between the pair of movable pieces so as to move the movable pieces in directions such that both pieces come closer with each other. Then, the pair of movable pieces driven to move in such directions that both pieces come closer with each other by the alignment motor touch both side edges of the bill and deformation resistance force of the bill becomes greater than that caused by holding torque of the alignment motor such that step-out or skidding occurs in the alignment motor, whereby the pair of movable pieces cannot move such that the center of the bill is aligned to the center of the traveling route (skew of the bill is also eliminated at the same time).

[Patent Reference 1] Japanese unexamined patent application publication No. 2002-279487

DISCLOSURE OF THE INVENTION

Problem to be Solved by the Invention

In the above-described publicly-known bill processing apparatus, the skew of the bill is corrected by the skew correction mechanism before the bill is fed to the bill identification part. However, when a user inserts the bill into the bill insertion slot, too much inclination of the bill to the traveling direction may cause bill jamming even before the bill is conveyed to the place where the bill is positioned between the pair of movable pieces.

In the present invention, there may be provided a paper sheet processing apparatus which is capable of correcting the inclination of the paper sheet to the traveling direction when the paper sheet is inserted into the insertion slot.

Means to Solve the Problem

In the present invention, a paper sheet processing apparatus comprises a pair of movable pieces capable of moving toward a center of a paper sheet traveling route through which a paper sheet is conveyed by a driving source, and the pair of movable pieces corrects inclination of the paper sheet to the traveling direction by regulating side edges of the paper sheet to be conveyed. The pair of movable pieces are moved toward the center of the traveling route to respective positions by the driving source before the paper sheet reaches the movable pieces such that a distance between one movable piece and the other movable piece is made shorter than the width of the paper sheet. Further features of the present invention, its nature, and various advantages will be more apparent from the accompanying drawings and the following description of the preferred embodiment.

DESCRIPTION OF NOTATIONS

Figure 1:
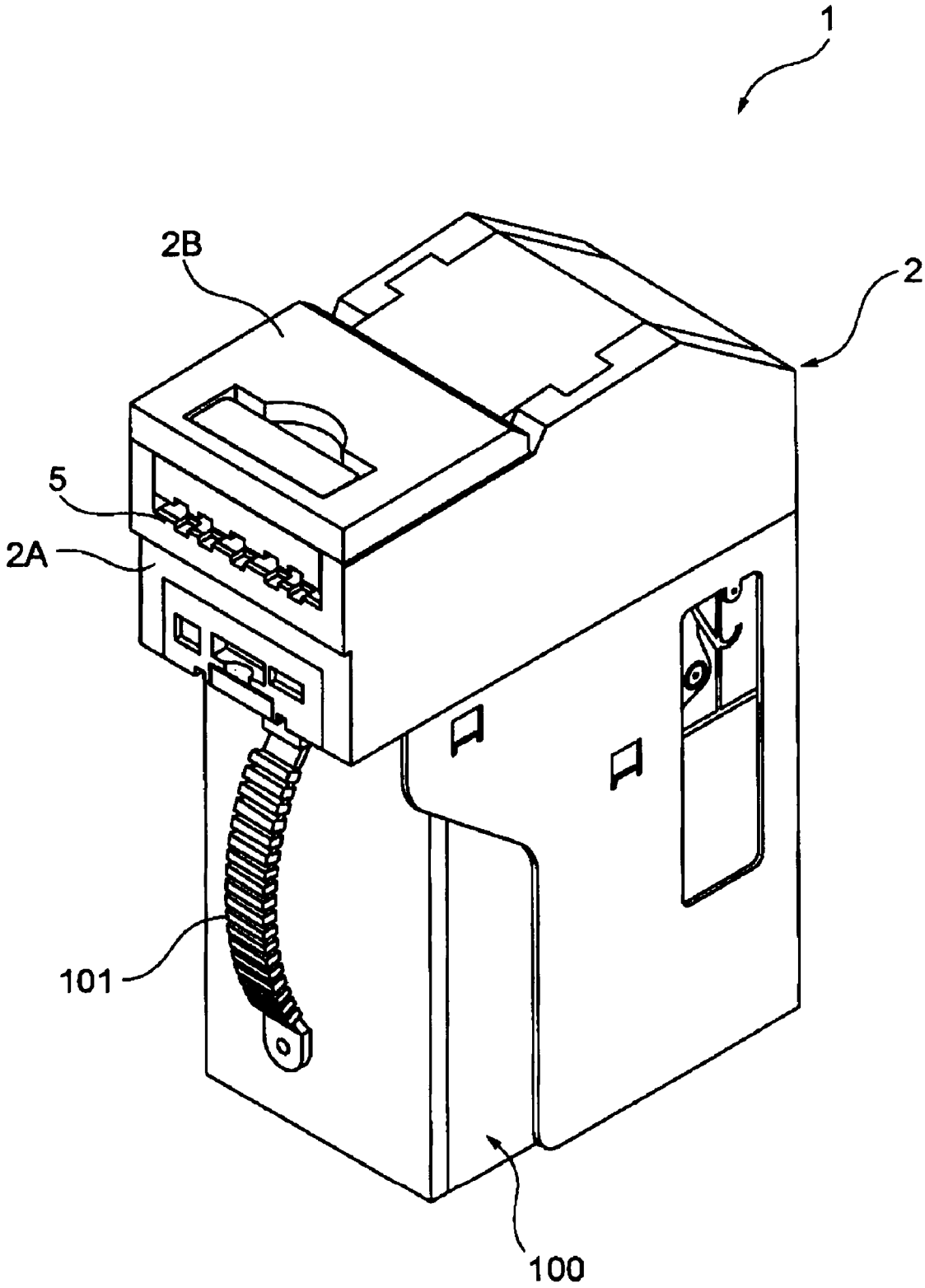
FIG. 1 is a perspective view showing an entire structure to illustrate an embodiment in which a paper sheet processing apparatus according to the present invention is applied to a bill processing apparatus.

1 bill processing apparatus
2 apparatus main body
3 bill traveling route
5 bill insertion slot
6 bill conveyance mechanism
8 bill reading means
10 skew correction mechanism
30A, 30B movable pieces
30*b* regulatory wall
31A, 31B base part
40 driving source
100 bill housing part
200 control means

BEST MODE FOR CARRYING OUT THE INVENTION

Hereinafter, one embodiment of the present invention will be described with reference to the drawings.

Figure 2:
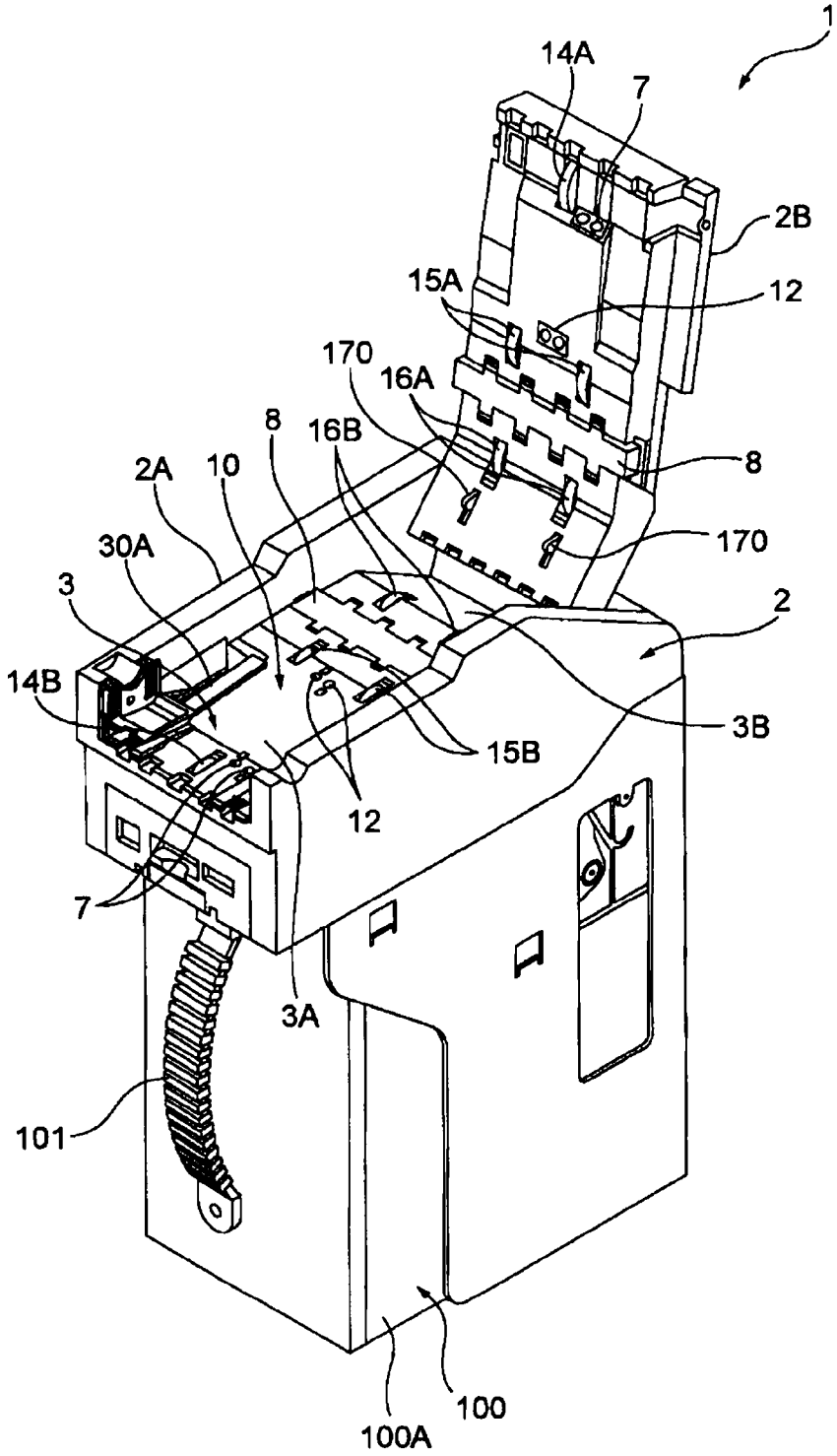
FIG. 2 is a perspective view showing the bill processing apparatus in a state that an open/close member is opened for a main body frame of an apparatus main body.
Figure 3:
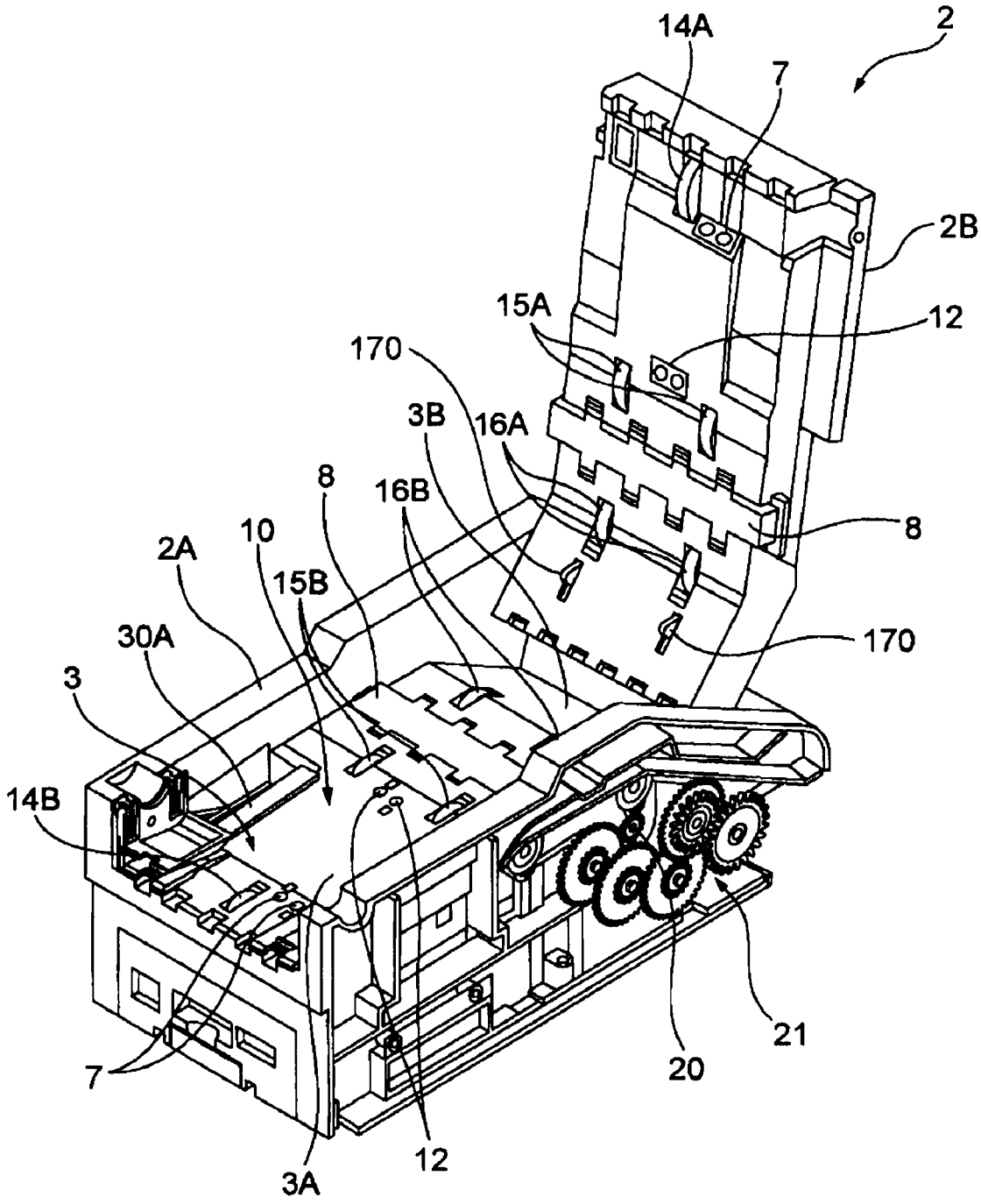
FIG. 3 is a perspective view showing a configuration of a power transmission part of the apparatus main body.
Figure 4:
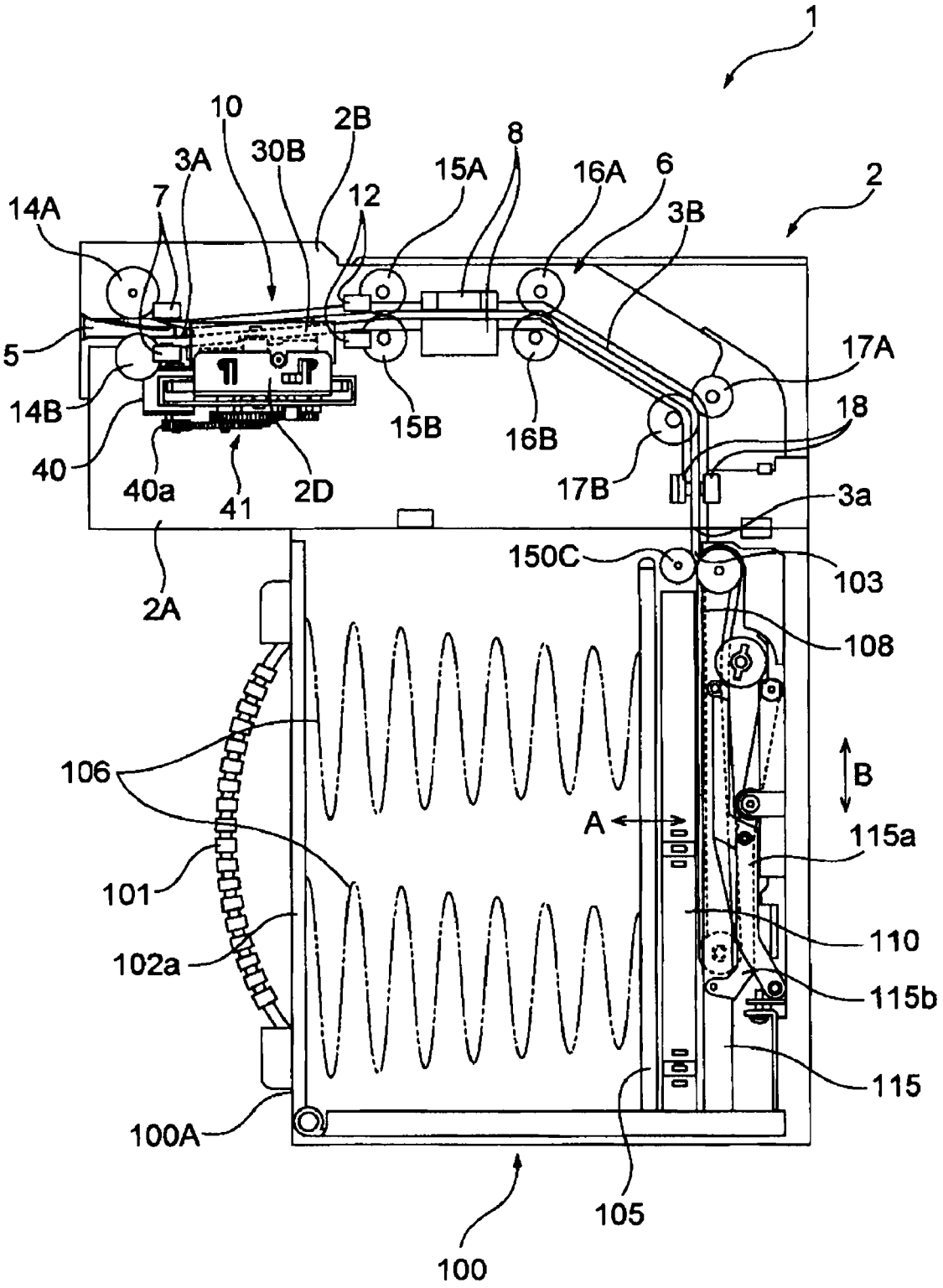
FIG. 4 is a right side view schematically showing a traveling route of a bill to be inserted from an insertion slot.
Figure 5:
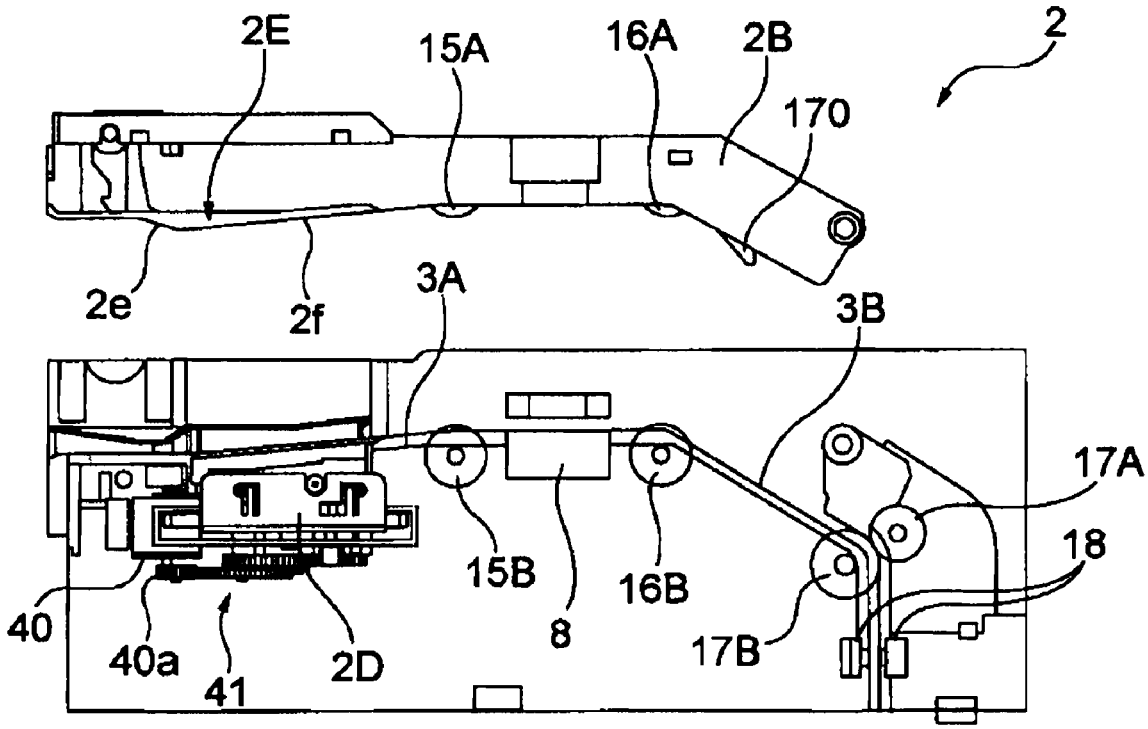
FIG. 5 is a right side view illustrating a state that an open/close member is removed from the apparatus main body.
Figure 6:
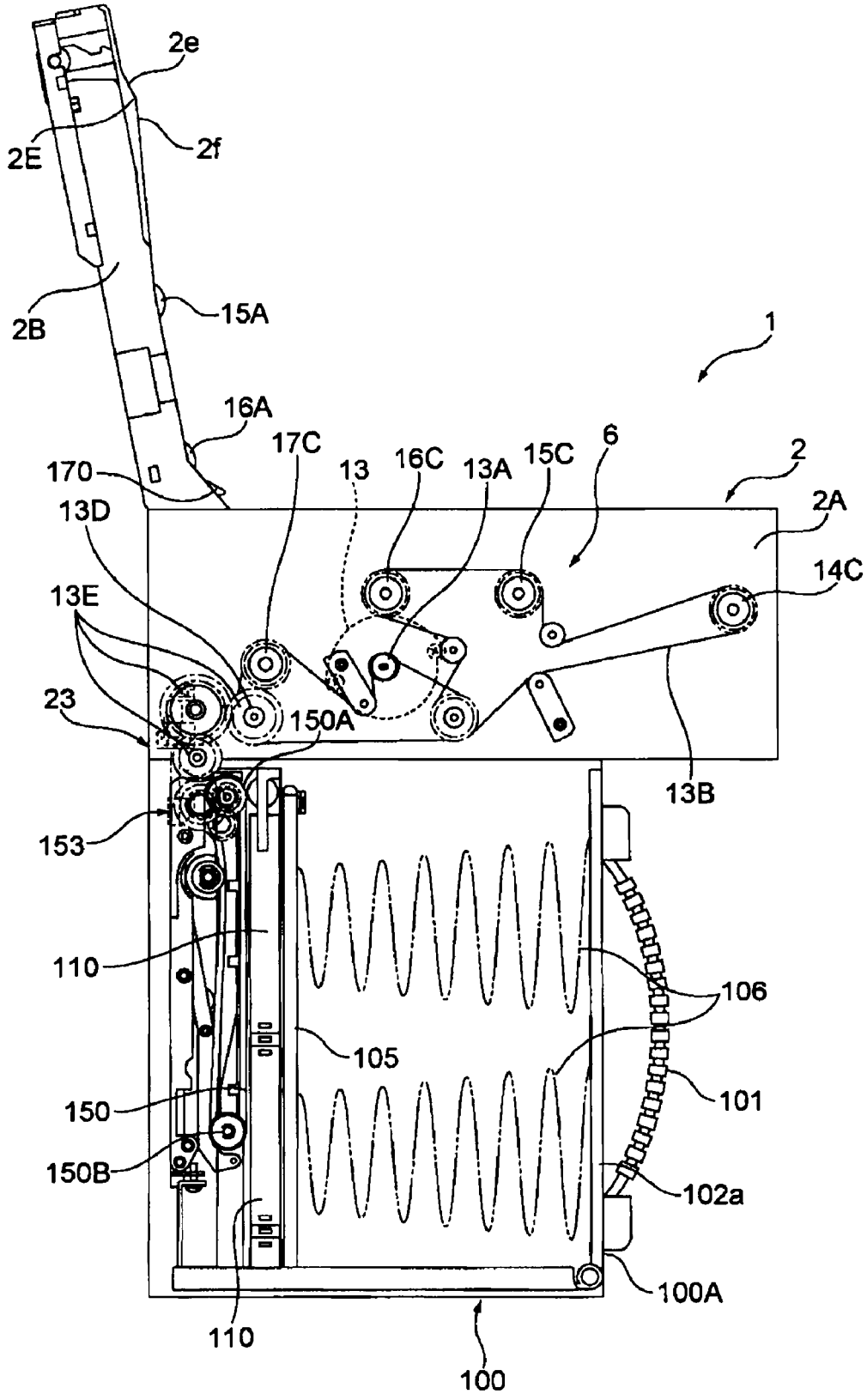
FIG. 6 is a left side view showing a schematic configuration of a driving source and a driving force transmission mechanism to drive a bill conveyance mechanism.
Figure 7:
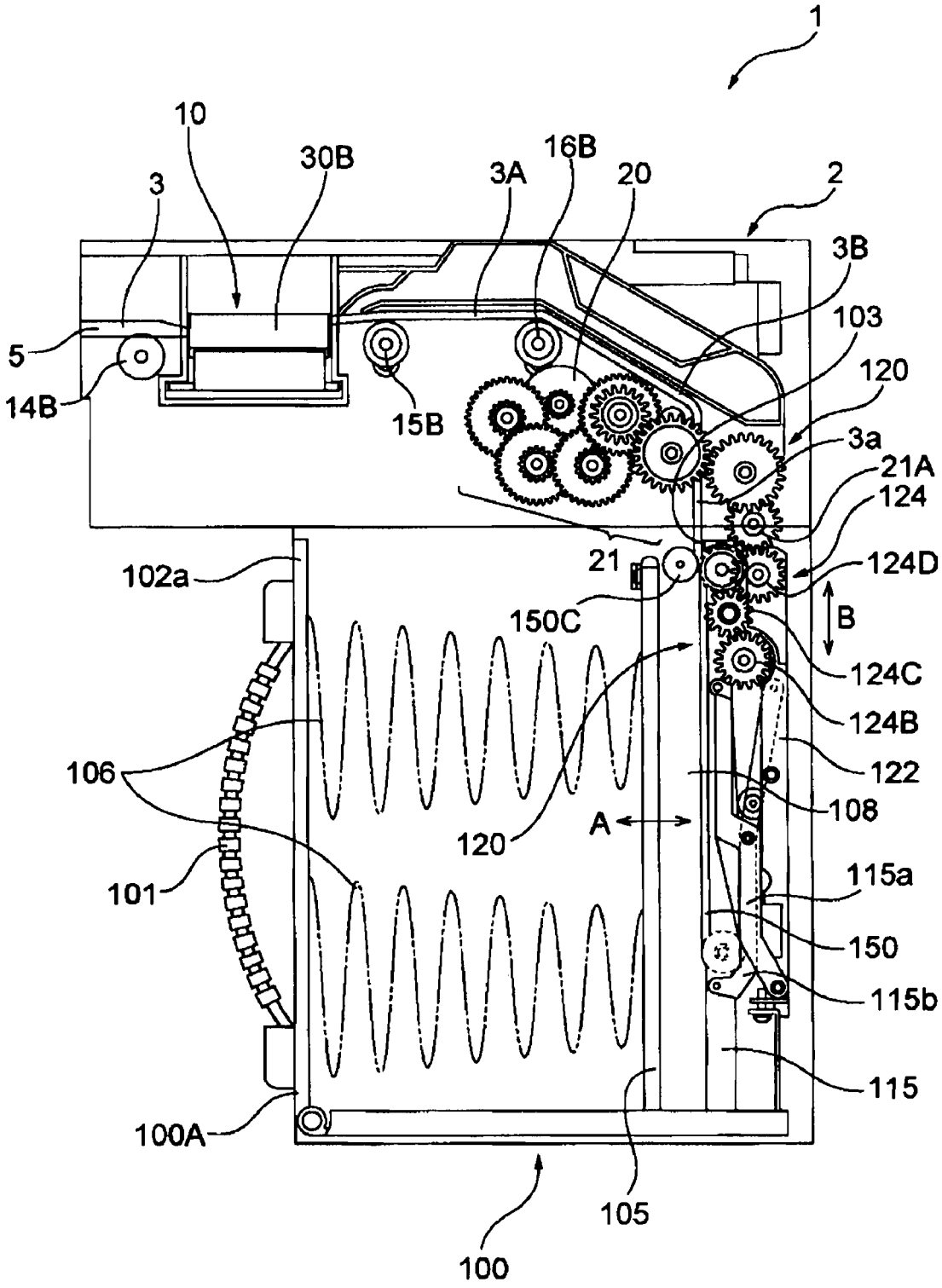
FIG. 7 is a diagram showing a schematic configuration of a power transmission mechanism for driving a presser plate arranged in a bill housing part.

FIGS. 1 to 7 are diagrams showing an embodiment in which a paper sheet processing apparatus of the present invention is applied to a bill processing apparatus; FIG. 1 is a perspective view showing an entire configuration thereof; FIG. 2 is a perspective view showing a state that an open/close member is opened for a main body frame of an apparatus main body; FIG. 3 is a perspective view showing a configuration of a power transmission part of the apparatus main body; FIG. 4 is a right side view schematically showing a traveling route of a bill inserted from an insertion slot; FIG. 5 is a right side view showing a state that the open/close member is removed from the apparatus main body; FIG. 6 is a left side view showing a schematic configuration of a driving source and a driving force transmission mechanism to drive a bill conveyance mechanism; and FIG. 7 is a diagram showing a schematic configuration of a power transmission mechanism for driving a presser plate arranged in a bill housing part.

A bill processing apparatus 1 of this embodiment is configured to be incorporable into, for example, various types of gaming machines such as slot machines, and the bill processing apparatus 1 includes an apparatus main body 2 and a bill housing part (e.g., bill stacker; safe) 100 which is provided on the apparatus main body 2, and is capable of stacking and housing a great number of bills. In this case, the bill housing part 100 may be mountable to and demountable from the apparatus main body 2, and the bill housing part 100 can be removed from the apparatus main body 2 by pulling a handle 101 provided onto a front face thereof in a state, for example, that a lock mechanism (not shown) is released.

As shown in FIGS. 2 and 3, the apparatus main body 2 has the main body frame 2A and an open/close member 2B configured to be opened and closed for the main body frame 2A by rotating around an axis positioned at one end thereof as a rotating center. Then, as shown in FIG. 4, the main body frame 2A and the open/close member 2B are configured to form a space (bill traveling route 3) through which a bill is conveyed such that the space is between a bottom face of the open/close member 2B and a top face of the main body frame 2A which are facing with each other when the open/close member 2B is closed for the main body frame 2A, and to form a bill insertion slot 5 such that front exposed faces of both are aligned and that the bill traveling route 3 exits at the bill insertion slot 5. In addition, the bill insertion slot 5 is a slit-like opening from which a short side of a bill in a thin plate shape can be inserted into the inside of the apparatus main body 2 such that the opening has a width narrower than the long side of the bill and wider than the short side of the bill.

In addition, a bill conveyance mechanism 6 that conveys the bill along the bill traveling route 3, an insertion detecting sensor 7 that detects the bill inserted into the bill insertion slot 5, bill reading means 8 that is installed on a downstream side from the insertion detecting sensor 7 and reads information on the bill in a traveling sate, a skew correction mechanism 10 that accurately positions and carries the bill for the bill reading means 8, a movable piece passage detecting sensor 12 that detects that the bill passes through the pair of movable pieces constituting the skew correction mechanism, and a discharge detecting sensor 18 that detects that the bill is discharged into the bill housing part 100 are provided inside the apparatus main body 2.

Hereafter, the respective components described above will be described in detail. The bill traveling route 3 extends from the bill insertion slot 5 toward the inside and comprises a first traveling route 3A and a second traveling route 3B which extends from the first traveling route 3A toward the downstream side so as to be inclined downward at a predetermined angle with respect to the first traveling route 3A. The second traveling route 3B is bent vertically on the downstream side thereof, a discharge slot 3*a* is formed on an end portion on the downstream side thereof so as to discharge the bill into the bill housing part 100, and the bill discharged therefrom is fed in a vertical direction into a feed port (receiving port) of the bill housing part 100.

The bill conveyance mechanism 6 is a mechanism capable of carrying the bill inserted from the bill insertion slot 5 along the insertion direction, and of carrying back the bill in an insertion state toward the bill insertion slot 5. The bill conveyance mechanism 6 comprises a motor 13 serving as a driving source installed in the apparatus main body 2; and conveyor roller pairs (14A and 14B), (15A and 15B), (16A and 16B), and (17A and 17B) which are installed at predetermined intervals along the bill traveling direction in the bill traveling route 3, and are driven to rotate by the motor 13.

The conveyor roller pairs are installed so as to be partially exposed on the bill traveling route 3, and all the pairs are constituted of driving rollers of the conveyor rollers 14B, 15B, 16B, and 17B installed on the underside of the bill traveling route 3 driven by the motor 13; and pinch-rollers of the conveyor rollers 14A, 15A, 16A, and 17A installed on the upperside and driven by the these driving rollers. In addition, the conveyor roller pair (14A and 14B) to first nip and hold therebetween the bill inserted from the bill insertion slot 5, and to convey the bill toward the back side, as shown in FIGS. 2 and 3, is installed in one portion of the center position of the bill traveling route 3, and a couple of the conveyor roller pairs (15A and 15B), (16A and 16B), or (17A and 17B) being disposed in this order on the downstream side thereof are respectively installed in a couple of portions with a predetermined interval in the lateral direction of the bill traveling route 3.

Further, the conveyor roller pair (14A and 14B) disposed in the vicinity of the bill insertion slot 5 is usually in a state that the upper conveyor roller 14A is spaced from the lower conveyor roller 14B, and the upper conveyor roller 14A is driven to move toward the lower conveyor roller 14B to nip and hold the inserted bill therebetween when insertion of the bill is sensed by the insertion detecting sensor 7.

Thus, the upper conveyor roller 14A is controllably driven to be pressed against or spaced from the lower conveyor roller 14B by a motor 70 for an up-and-down movement of the roller as a driving source. In this case, when a process (skew correction process) for positioning the bill with respect to the bill reading means 8 by eliminating inclination of the inserted bill is executed by the skew correction mechanism 10, the upper conveyor roller 14A is spaced from the lower conveyor roller 14B so as to release the load on the bill, and when the skew correction process is completed, the upper conveyor roller 14A is driven to move toward the lower conveyor roller 14B again to hold (or nip) the bill therebetween. Here, the driving source may be constituted of a solenoid or the like instead of a motor.

The conveyor rollers 14B, 15B, 16B and 17B installed on the underside of the bill traveling route 3 are, as shown in FIG. 6, driven to rotate via the motor 13 and pulleys 14C, 15C, 16C, and 17C installed at the ends of the driving shafts of the respective conveyor rollers. That is, a driving pulley 13A is installed on the output shaft of the motor 13, and a driving belt 13B is wrapped around between the pulleys 14C, 15C, 16C, and 17C installed at the ends of the driving shafts of the respective conveyor rollers and the driving pulley 13A. In addition, tension pulleys are engaged in places with the driving belt 13B, which prevents the driving belt 13B from loosening.

In accordance with the configuration described above, when the motor 13 is driven to normally rotate, the conveyor rollers 14B, 15B, 16B, and 17B are driven to normally rotate in synchronization therewith to carry the bill toward the insertion direction. When the motor 13 is driven to reversely rotate, the conveyor rollers 14B, 15B, 16B, and 17B are driven to reversely rotate in synchronization therewith to carry back the bill toward the bill insertion slot 5 side.

The insertion detecting sensor 7 is to generate a detection signal when a bill inserted into the bill insertion slot 5 is detected. In this embodiment, the insertion detecting sensor 7 is installed between the pair of conveyor rollers (14A and 14B) and the skew correction mechanism 10. The insertion detecting sensor 7 comprises, for example, an optical sensor, specifically for example, a regressive reflection type photo sensor. However, the insertion detecting sensor 7 may comprise a mechanical sensor other than the optical sensor.

Further, the movable piece passage detecting sensor 12 is to generate a detection signal when it is detected that a front end of the bill passes through the movable pieces constituting the skew correction mechanism 10, and the movable piece passage detecting sensor 12 is installed on the upstream side of the bill reading means 8. The movable piece passage detecting sensor 12 also comprises an optical sensor or a mechanical sensor in the same way as mentioned before with respect to the insertion detecting sensor. In addition, the movable piece passage detecting sensor 12 generates a bill back end detection signal in order to perform a movable piece closing process which will be described later when a back end position of the bill to be carried is detected.

Further, the discharge detecting sensor 18 is to detect a back end of the bill passing through such that it is detected that the bill is discharged into the bill housing part 100. The discharge detecting sensor 18 is disposed just in front of the receiving port 103 of the bill housing part 100 on the downstream side of the second bill traveling route 3B. When the detection signal is transmitted from the discharge detecting sensor 18, the driving by the motor is stopped and the conveyance processing of the bill is terminated. The discharge detecting sensor 18 also comprises an optical sensor or a mechanical sensor in the same way as the aforementioned insertion detecting sensor.

The bill reading means 8 reads bill information on the bill to be conveyed in a state that the skew is eliminated by the skew correction mechanism 10, and judges its validity (authenticity). In detail, for example, the bill reading means 8 may comprise a line sensor that performs reading of the bill such that a bill to be carried is irradiated with light from upper and lower sides, and transmitted light therethrough and reflected light therefrom are detected by a light receiving element. A line sensor is shown in the drawing, and an optical signal read by the line sensor is photoelectric-converted, and the signal is compared and checked with data of a legitimate bill stored in advance, which makes it possible to identify the authenticity of the bill to be carried.

The bill housing part 100 that houses bills is so configured as to be mountable to and demountable from the apparatus main body 2, and to stack and house sequentially the bills having been identified as being genuine by the bill reading means 8.

As shown in FIGS. 4, 6, and 7, the main body frame 100A constituting the bill housing part 100 is formed into a substantially rectangular parallelepiped (or cuboid) shape, and one end of bias means (e.g., bias spring) 106 is attached to an interior side of a front wall 102*a* thereof, and a placing plate 105 on which bills to be fed via the above-described receiving port 103 are sequentially stacked is provided to the other end thereof. Therefore, the placing plate 105 is in a state that it is pressed toward the presser plate 115, which will be described later, by the bias means 106.

In the main body frame 100A, a press standby part 108 that keeps a dropping bill as it falls is provided so as to continuously communicate with the receiving port 103. A pair of regulatory members 110 are disposed on both sides of the press standby part 108, respectively, the regulatory members 110 extending in a vertical direction. An opening is formed between the pair of regulatory members 110 such that the presser plate 115 passes through the opening as bills are successively stacked onto the placing plate 105.

Further, protruding walls are formed on both side walls inside the main body frame 100A such that the placing plate 105 may hit and contact thereon when the placing plate is pressed by the biasing means 106. When the placing plate is biased back by the biasing means 106 after bills are sequentially stacked on the placing plate 105, the protruding walls take a holding role to stably hold the stacked bills by hitting and contacting both sides of a surface of an uppermost bill M1 of the stacked bills.

Further, the presser plate 115 that presses toward the placing plate 105 a bill falling into the press standby part 108 from the receiving port 103 is installed in the main body frame 100A. The presser plate 115 is formed in such a size that it may be capable of reciprocating through an opening formed between the pair of regulatory members 110, and gets into the opening so as to be driven to reciprocate between a position where the bills are pressed against the placing plate 105 (a pressing position) and another position where the press standby part 108 is opened (an initial position). In this case, the bill passes through the opening as being flexibly bent in a pressing operation of the presser plate 115 and is then placed on the placing plate 105.

The presser plate 115 is driven to reciprocate as described above via a presser plate driving mechanism 120 installed in the main body frame 100A. The presser plate driving mechanism 120 comprises a pair of link members 115*a* and 115*b* having respective ends thereof supported pivotally by the presser plate 115 so as to allow the presser plate 115 to reciprocate in an arrow A direction in FIGS. 4 and 7, and these link members 115*a* and 115*b* are connected in a shape of letter "X", and the other ends opposite to the respective ends are supported pivotally by a movable member 122 installed movably in a vertical direction (an arrow B direction). A rack is formed in the movable member 122, and a pinion constituting the presser plate driving mechanism 120 is geared (engaged) with the rack.

As shown in FIG. 7, a housing part side gear train 124 constituting the presser plate driving mechanism 120 is connected to the pinion. For this case, in this embodiment, a driving source (a motor 20) and a main body side gear train 21 sequentially engaged with the motor 20 are installed in the above-described apparatus main body 2, and when the bill housing part 100 is mounted to the apparatus main body 2, the main body side gear train 21 is to be connected to the housing part side gear train 124. That is, the housing part side gear train 124 comprises a gear 124B installed on the same axis of the pinion and gears 124C, 124D to be engaged sequentially with the gear 124B, and when the bill housing part 100 is mounted to and demounted from the apparatus main body 2, the gear 124D is configured to be engaged with and disengaged from a final gear 21A of the main body side train 21.

As a result therefrom, the presser plate 115 is driven to reciprocate in the arrow A direction as the motor 20 installed in the apparatus main body 2 is driven to rotate so as to drive the main body side train 21 and in turn the presser plate driving mechanism 120 (the housing part side gear train 124, the rack installed onto the movable member 122, and the link members 115*a*, 115*b*, etc.).

Conveyor members 150 which are capable of touching the bill conveyed-in from the receiving port 103 are installed in the main body frame 100A. The conveyor members 150 take their own role to contact the bill conveyed-in so as to stably guide the bill to an appropriate position in the press standby part 108 (position where the bill can be stably pressed without causing the bill to be moved to the right or left side when the bill is pressed by the presser plate 115). In this embodiment, the conveyor members are constituted of belt-like members (hereafter called belts 150) installed so as to face the press standby part 108.

In this case, the belts 150 are installed so as to extend along the conveying-in direction with respect to the bill, and are wrapped around the pair of pulleys 150A and 150B supported rotatably on both ends in the conveying-in direction. Further, the belts 150 contact a conveyor roller 150C extending in an axis direction which is supported rotatably in the region of the receiving port 103, and the belts 150 and the conveyor roller 150C nip and hold the bill conveyed-in the receiving port 103 therebetween to guide the bill directly to the press standby part 108. Moreover, in this embodiment, the pair of belts 150 are provided on the right and left sides, respectively, across the above-described presser plate 115 in order to be capable of contacting the surface on left and right sides of the bill. Here, the belts 150 may be prevented from loosening by not only being wrapped around the pulleys 150A and 150B at the both ends, but also causing tension pulleys to push the belts 150 at the intermediate positions, respectively.

The pair of belts 150 are configured to be driven by the motor 13 that drives the above-described plurality of conveyor rollers installed in the apparatus main body 2. In detail, as shown in FIG. 6, the above-described driving belt 13B driven by the motor 13 is wrapped around a pulley 13D for the driving force transmission, and a gear train 153 installed at the end of the spindle of the pulley 150A supported rotatably on the receiving port 103 side is engaged with a gear train 13E for the power transmission sequentially installed onto the pulley 13D. That is, when the bill housing part 100 is mounted to the apparatus main body 2, an input gear of the gear train 153 is configured to be engaged with a final gear of the gear train 13E, and the pair of belts 150 are configured to be driven to rotate in a synchronized manner with the above-described conveyor rollers 14B, 15B 16B, and 17B for conveying the bill by driving the motor 13 to rotate.

As described above, when the bill is inserted into the inside via the bill insertion slot 5, the bill is moved inside the bill traveling route 3 by the bill conveyance mechanism 6. As shown in FIG. 3, the bill traveling route 3 has the first traveling route 3A which is extended from the bill insertion slot 5 toward the back side, and the second traveling route 3B which is extended from the first traveling route 3A toward the downstream side and is inclined at a predetermined angle to the first traveling route 3A. A shutter member 170 that prevents the bill from being conveyed toward the bill insertion slot 5 by a fraudulent activity is installed in the second traveling route 3B.

Figure 8:
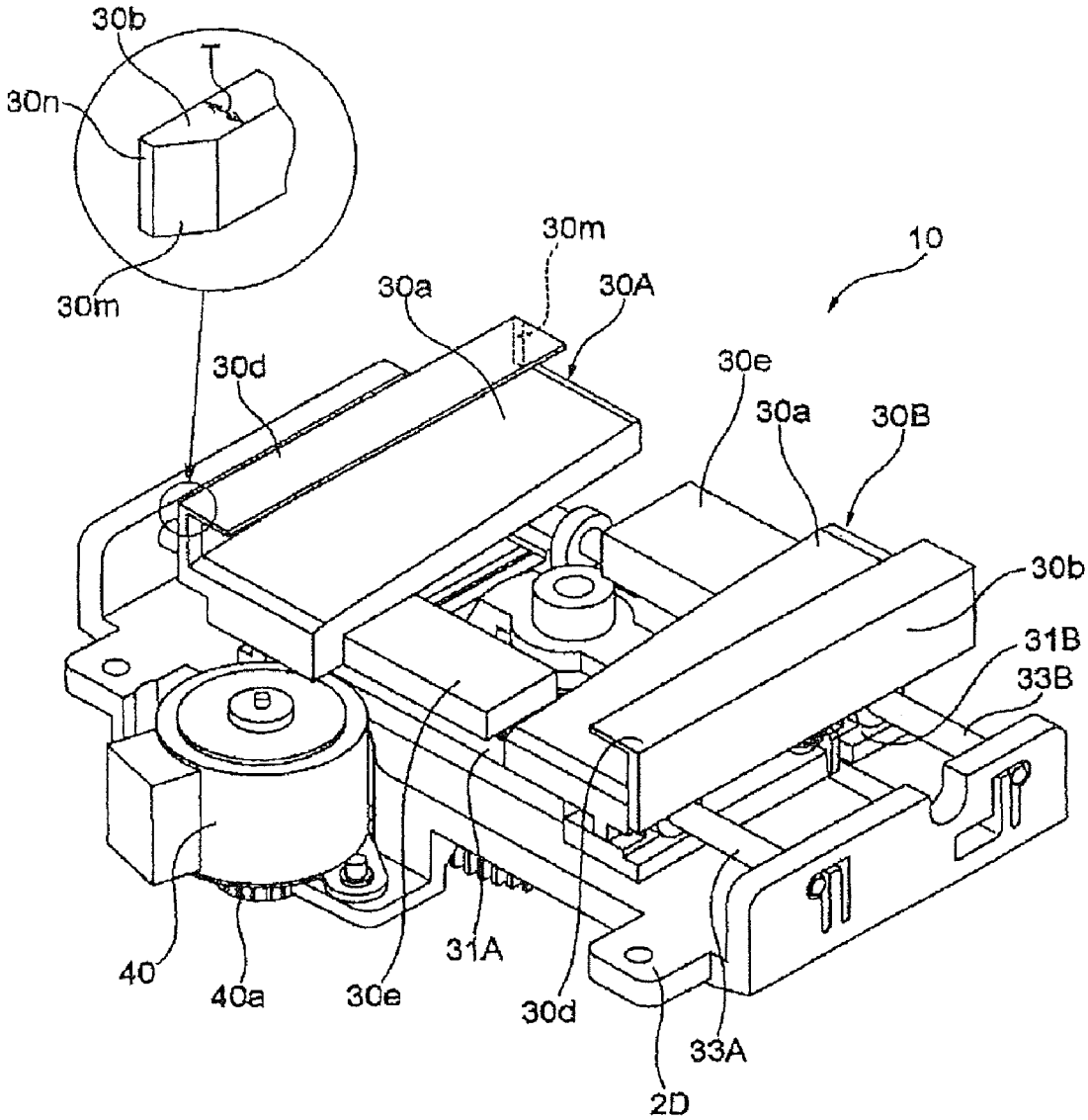
FIG. 8 is a perspective view showing an entire configuration of a skew correction mechanism.
Figure 9:
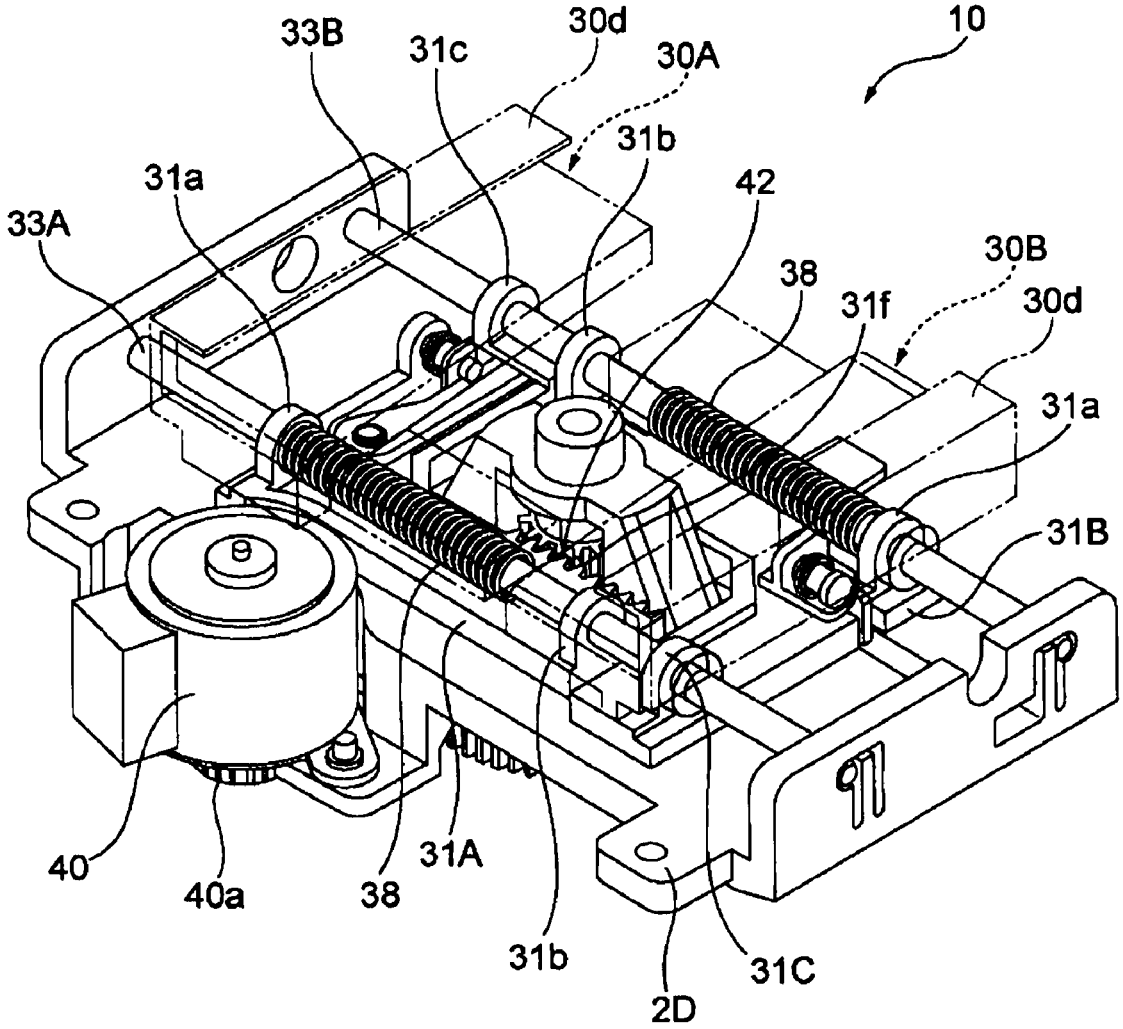
FIG. 9 is a diagram showing an arrangement of springs installed between movable pieces and base parts.
Figure 10A:
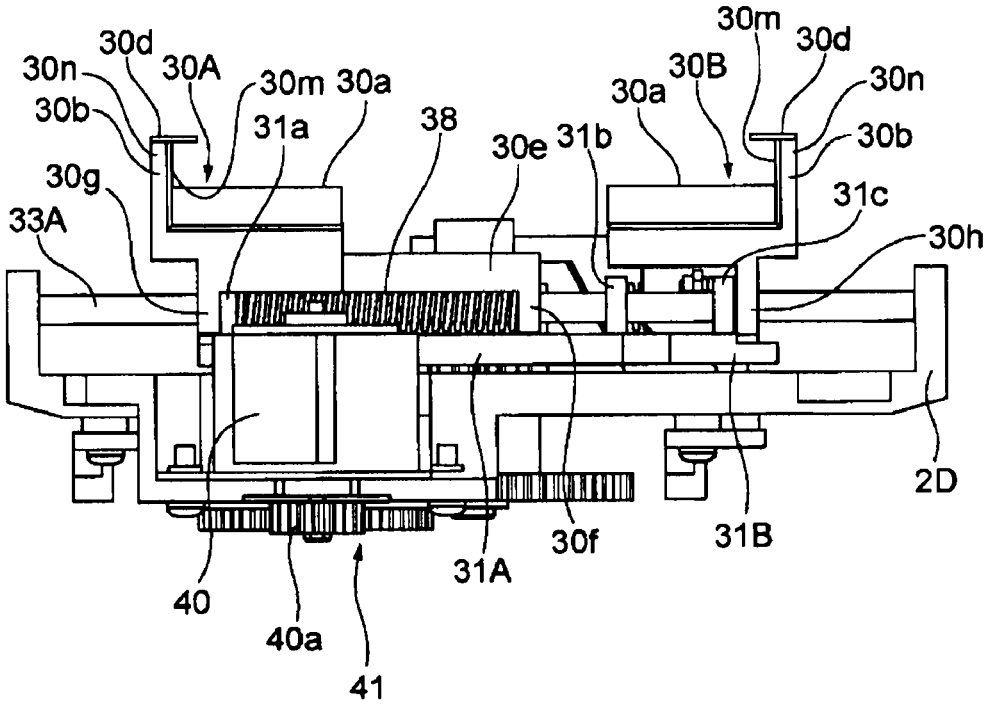
FIG. 10A is a front view of the skew correction mechanism shown in FIG. 8, which is viewed from the bill insertion slot side.
Figure 10B:
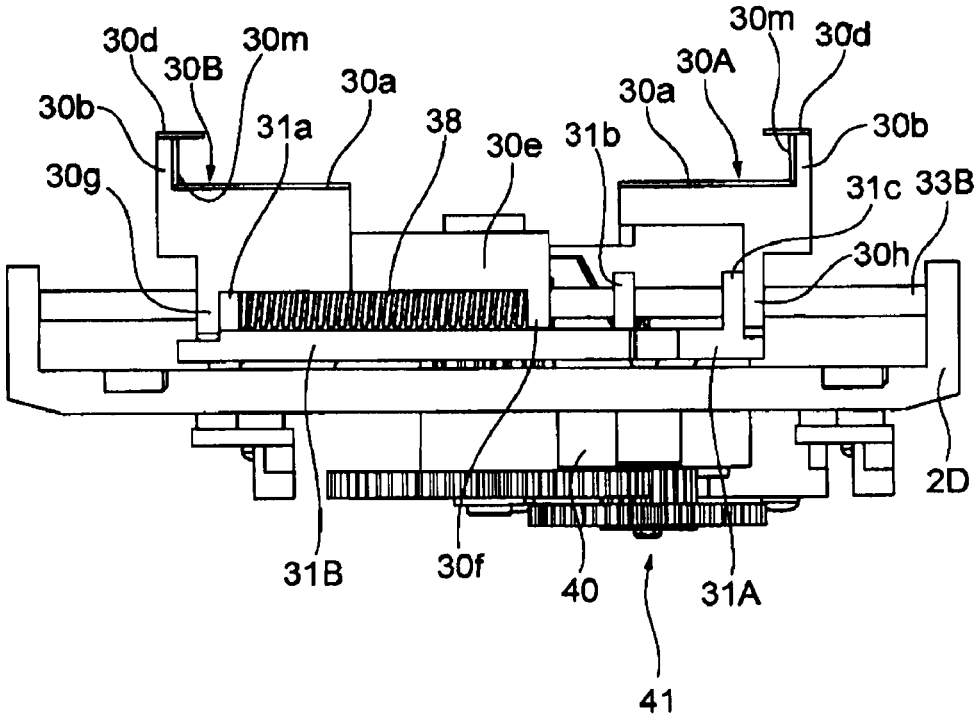
FIG. 10B is a back view of the skew correction mechanism shown in FIG. 8, which is viewed from an opposite side to the bill insertion slot side.
Figure 11:
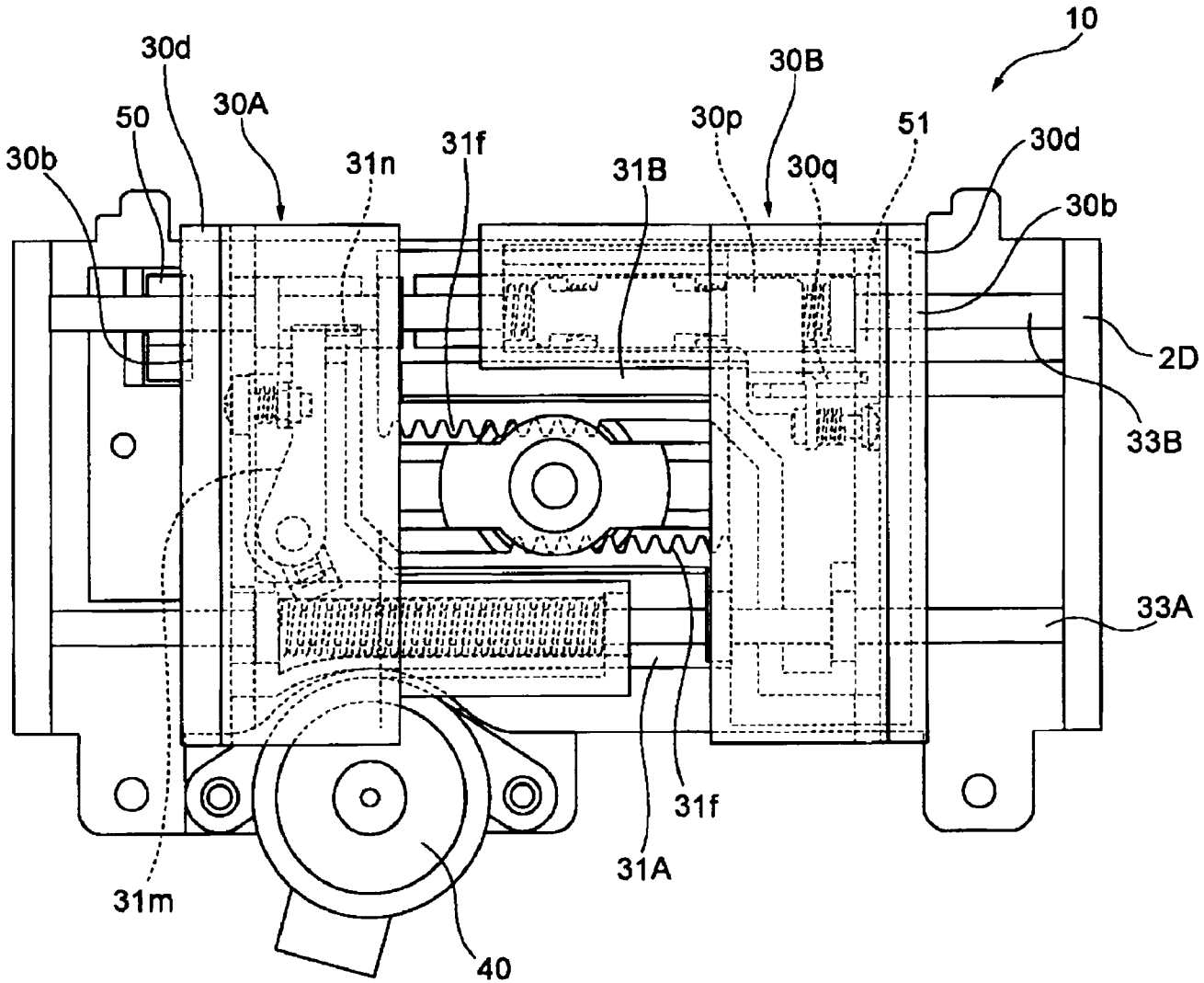
FIG. 11 is a plan view of the skew correction mechanism.
Figure 12A:
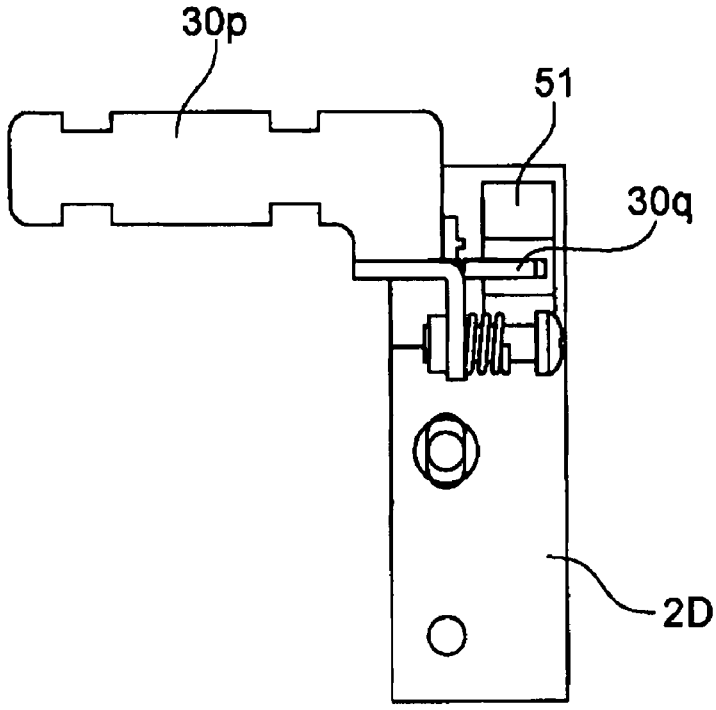
FIG. 12A is a diagram showing a configuration of a movable piece sensor part (movable piece detecting sensor) shown in FIG. 11.
Figure 12B:
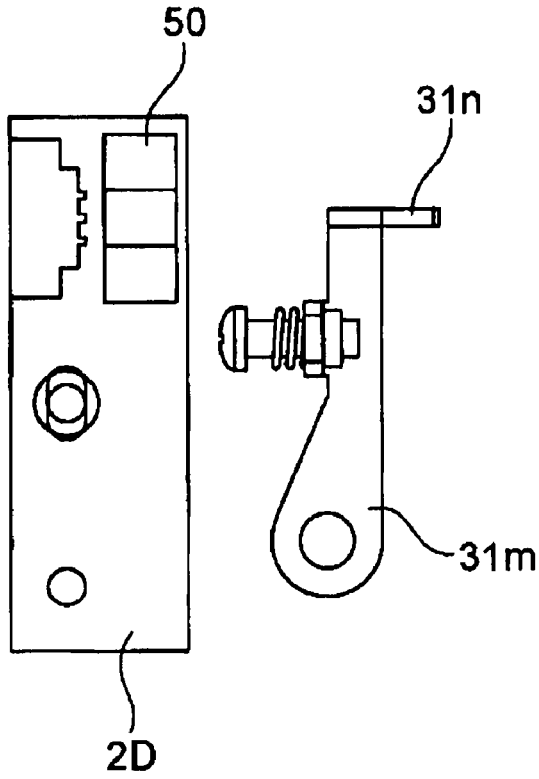
FIG. 12B is a diagram showing a configuration of a base part sensor (base part detecting sensor) shown in FIG. 11.

Next, the skew correction mechanism 10 will be described in detail with reference to FIGS. 8 to 12B. Here, in these diagrams, FIG. 8 is a perspective view showing an entire configuration of a skew correction mechanism; FIG. 9 is a diagram showing an arrangement of springs installed between movable pieces and base parts; FIG. 10A is a front view of the skew correction mechanism shown in FIG. 8, which is viewed from the bill insertion slot side; FIG. 10B is a back view of the skew correction mechanism shown in FIG. 8, which is viewed from an opposite side to the bill insertion slot side; FIG. 11 is a plan view of the skew correction mechanism; FIG. 12A is a diagram showing a configuration of a movable piece sensor (movable piece detecting sensor) shown in FIG. 11; and FIG. 12B is a diagram showing a configuration of a base part sensor portion (base part detecting sensor) shown in FIG. 11.

The skew correction mechanism 10 is installed on the surface portion of the bill traveling route 3 through which a bill is conveyed in the main body frame 2A of the apparatus main body 2. In FIG. 8 the bill insertion direction is generally in a direction from driving source 40 toward extended part 30*e*, and the skew correction mechanism 10 of this embodiment comprises a pair of movable pieces 30A, 30B which are installed so as to be bilaterally-symmetric with respect to the center line of the bill traveling route and regulate both side edges of the bill to be inserted in parallel with the traveling direction. Then, these movable pieces 30A, 30B are installed on a pair of base parts 31A, 31B which come close to/are spaced from each other in a direction perpendicular to the bill traveling direction with respect to the main body frame 2A.

Hereinafter, the configuration of the movable pieces 30A, 30B and the base parts 31A, 31B will be described. Here, in the following description, since these members have a bilaterally-symmetric structure, the components on either side (the movable piece 30A and the base part 31A on the left side viewed from the insertion direction) will be mainly described. Further, with respect to the movable pieces 30A, 30B and the base parts 31A, 31B, like reference numerals refer to like components.

Two guide members 33A, 33B extending in a direction perpendicular to the bill traveling direction are installed with a predetermined interval along the bill traveling direction onto a base 2D that is integrated with the main body frame 2A. Then, the base part 31A is installed so as to be axially movable with respect to the guide member 33A, and the base part 31B is installed so as to be axially movable with respect to the guide member 33B.

In this case, the base part 31A is formed so as to extend along the guide member 33A and is installed so as to be axially movable with respect to the guide member 33A as the guide member 33A is inserted into through-holes that are formed in a pair of flanges 31*a*, 31*b*. Further, the base part 31A is formed in a shape bent at the right angle toward the guide member 33B side such that the base part 31A can stably move when the base part 31A moves along the guide member 33A and the base part 31A is also held with respect to the guide member 33B. In FIG. 10B, a flange portion of the base part 31A is held with respect to the guide member 33B and such flange portion is indicated by reference numeral 31*c*. In addition, the base part 31B is also formed to extend along the guide member 33B in a similar structure, and is installed so as to be axially movable with respect to the guide member 33B because the guide member 33B is inserted into through-holes formed in the pair of flanges 31*a*, 31*b*, and the base part 31B is formed in a shape bent at the right angle toward the guide member 33A side and is also held with respect to the guide member 33A. In a similar way, in FIG. 10A, a flange portion of the base part 31B is held with respect to the guide member 33A and is indicated by reference numeral 31*c*.

A flat surface 30*a* facing the rear surface of the bill traveling route 3 and a plate-like regulatory wall 30*b* which is formed on a side end portion of the flat surface 30*a* and touches a side edge of the bill to be conveyed, are formed on the movable piece 30A. In accordance therewith, the movable piece 30A is installed such that the regulatory wall 30*b* portion protrudes upward from the bill traveling route 3. Further, a ceiling plate 30*d* is integrally formed onto the top end portion of the regulatory wall 30*b* so as to cover a side end portion along a longitudinal direction of the bill to be conveyed along the traveling direction. In this way, since the ceiling plates 30*d* are formed on the top end portions of the regulatory walls 30*b* of both movable pieces 30A, 30B, the upward movement of the bill to be convey is regulated such that bill jamming may be prevented.

Here, as shown in FIGS. 5 and 6, a raised portion 2E with an inclined slope profile is formed on the rear surface of the open/close member 2B described above so as to get into a space between the ceiling plates 30*d* formed on the top end portions of the regulatory walls 30*b* of the both movable pieces 30A, 30B when the open/close member 2B is closed with respect to the main body frame 2A. The raised portion 2E is formed with a first inclined guide face 2*e* gradually coming down as it goes in the insertion direction of the bill, and a second inclined guide face 2*f* gradually coming down as it goes in the discharging direction of the bill, and effectively prevents the bill from being moving up when the bill moves in an area of the skew mechanism. That is, when the bill is moved toward the inside of the apparatus, the bill is pressed down by the pair of ceiling plates 30*d* and the first inclined guide face 2*e* such that the upward movement of the bill may be prevented while the bill is pressed down by the above-mentioned pair of ceiling plates 30*d* and the second inclined guide face 2*f* such that the upward movement of the bill may be prevented when the bill is moved toward the bill discharge slot.

Further, the front end potions and the back end portions of the respective regulatory walls 30*b* of the both movable pieces 30A, 30B are formed so as to be gradually thinner as it goes toward either end. More specifically, as shown in an enlarged view of FIG. 8 (only the front end portion is shown in the drawing), assuming that a wall thickness of the regulatory wall 30*b* is T, an inclined surface 30*m* is formed such that the wall thickness T gets gradually thinner, whereby it is prevented that the bill touching the end portions of the both regulatory walls 30*b* is damaged when the pair of movable pieces 30A, 30B are moved for releasing to perform a skew correction. In this case, it is preferable to form touching faces 30*n* perpendicular to the bill traveling direction on the respective front end portions of the both regulatory walls 30*b* in order to have a function to correct (realign) an obliquely-passing state at the time of inserting the bill by hitting the front end edge of the inserted bill on the front end portions of the both regulatory walls 30*b*. Further, such touching faces may be formed onto the back end portions of the respective regulatory walls 30*b*.

The movable piece 30A having the shape as described above is supported on the base part 31A in a state that a spring 38 is interposed therebetween so as to be relatively movable with respect to the base part 31A. More specifically, an extended part 30*e* extending toward the central side in the axial direction of the guide member 33A is formed to the movable piece 30A, and a flange 30*f* including a through hole through which the guide member 33A is inserted is formed on an end portion of the extended part 30*e*. Then, the spring 38 that biases the movable piece 30A toward the center of the bill traveling route is interposed between the flange 30*f* and the flange 31*a* formed on the base part 31A.

Further, a flange 30*g* including a through hole through which the guide member 33A is inserted is formed on the outer side along the axial direction of the movable piece 30A. In this case, since the movable piece 30A is in a state to be biased toward the center of the bill traveling route by the spring 38, the flange 30*g* of the movable piece 30A is brought into a contact with the flange 31*a* formed on the base part 31A as shown in FIG. 10A.

Moreover, a flange 30*h* including a through hole through which the guide member 33B is inserted is formed to the movable piece 30A so as to be supported with respect to the guide member 33B. As shown in FIG. 10B, the flange 30*h* is installed so as to be located on the outer side along the axial direction of the flange 31*c* formed on the base part 31A, and as described above, because the movable piece 30A is in a state to be biased toward the center of the bill traveling route by the spring 38, the flange 30*h* of the movable piece 30A is brought into a contact with the flange 31*c* formed on the base part 31A.

Then, the base parts 31A, 31B supporting the movable pieces 30A, 30B in a relatively movable manner as described above are driven so as to get closer with each other and closer to the center of the bill traveling route, and leave from each other and from the center by a driving source 40 installed on the base 2D integrated with the main body frame 2A. In this embodiment, the driving source 40 comprises a motor, and the base parts 31A, 31B are driven via a power transmission mechanism (a gear train 41 sequentially engaged with a drive gear 40*a* installed on the output shaft of the motor). More specifically, a pinion 42 which is the final gear of the gear train 41 is disposed so as to be located at an intermediate position between the guide members 33A, 33B, and racks 31*f* formed on the base parts 31A, 31B so as to face with each other are engaged with the pinion 42. That is, when the motor 40 drives to normally rotate, the base parts 31A, 31B are moved in the direction so as to get closer to each other via the pinion 42 and the racks 31*f*, and when the motor (driving source) 40 is driven to reversely rotate, the base parts 31A, 31B are moved in such a direction that both are separated from each other via the pinion 42 and the racks 31*f*.

Here, another driving source than what is described above, for example, a solenoid or a linear motor may be incorporated into the configuration with respect to the movement of the base parts 31A, 31B.

As described above, the movable piece 30A is moved toward the center of the bill traveling route by biasing force of the spring 38 interposed between the movable piece 30A and the base part 31A when the base part 31A is driven to move toward the center of the bill traveling route by the motor 40. Then, when the base part 31A moves toward the center of the bill traveling route, the regulatory wall 30*b* of the movable piece 30A touches the side edge of the bill, whereby load by reactive force of the bill is applied to the motor 40. In this case, the base part 31A is further movable toward the center of the bill traveling route with respect to the movable piece 30A against the biasing force of the spring 38.

More specifically, it is preferable that the biasing force of the spring 38 is set to be less than the reactive force of the bill to be conveyed between the movable pieces 30A, 30B, but is set to be an extent that the bill can be moved toward the center of the bill traveling route. That is, as will be described later, the base parts 31A, 31B are driven so as to get closer to each other in a state that the bill is located between the movable pieces 30A, 30B when skew of the bill is eliminated. In such a case, the bill is elastically bent in a curved shape since the movable pieces 30A, 30B touch the side edges of the bill such that its reactive force is applied to the movable pieces 30A, 30B. Provided that the biasing force of the spring 38 is set in advance as described above, it would be less likely that the bill is bent by the movable pieces 30A, 30B, and it would be possible to move the bill farther toward the center (to be moved so as to be aligned to the center line).

Further, as shown in FIGS. 11, 12A, and 12B, a base part detecting sensor 50 that detects positions of the base parts 31A, 31B, and a movable piece detecting sensor 51 that senses positions of the movable pieces 30A, 30B are installed in the skew correction mechanism 10. In this case, as described above, because the base parts and the movable pieces is in such a configuration that the base parts and the movable pieces are moved in a bilaterally symmetrical manner so that the base part detecting sensor 50 is configured to detect the base part 31A on the left side, and the movable piece detecting sensor 51 is configured to detect the movable piece 30B on the right side.

The base part detecting sensor 50 is installed outside the bill traveling route of the base 2D, and is configured to comprise an optical sensor in which a light emitting part and a light receiving part face with each other. A fixed piece 31*m* is screwed shut to the base part 31A, and when a sensor passage part 31*n* integrally formed with the fixed piece 31*m* gets into a detecting part of the base part detecting sensor 50 by a movement of the base part 31A in the separating direction, a predetermined position of the base part 31A is to be detected. In this case, the base part detecting sensor 50 is to detect a position where the base part 31A is located farthest from the center of the bill traveling route (a position to which the base part 31A is moved so as to make the maximum width; a predetermined position).

The movable piece detecting sensor 51 is installed on an intermediate side of the bill traveling route of the base 2D, and is constituted of an optical sensor in which a light emitting part and a light receiving part face with each other. A fixed piece 30*p* is screwed shut to the movable piece 30B, and when a sensor passage part 30*q* integrated with the fixed piece 30*p* gets into a detecting part of the movable piece detecting sensor 51 by a movement of the base part 312 to the center of the bill traveling route and moves away therefrom, a predetermined position of the movable piece 30B is to be detected. In this case, the movable piece detecting sensor 51 detects a position where the movable piece 30B gets closet to the center of the bill traveling route (a position to which the movable piece 30B moves so as to make the minimum width; a predetermined position). Further, the movable piece detecting sensor 51 detects a movement of the movable piece 30B after the movable piece 30B is moved toward the center of the bill traveling route and more specifically to the aforementioned predetermined position.

That is, as will be described later, the pair of movable pieces 30A, 30B has a function to prevent a fraudulent activity such as drawing out the bill and the like by narrowing the bill traveling route 3 with a closing movement thereof to the predetermined position such that the fraudulent activity can be detected by detecting a movement of widening the pair of movable pieces when an action of drawing out the bill is actually made.

Further, as will be described later, before the bill having been inserted into the bill insertion slot 5 reaches the pair of movable pieces 30A, 30B as described above, the movable pieces are respectively moved by the motor 40 to positions where the pair of movable pieces is so arranged that the distance between one movable piece and the other movable piece becomes shorter than the width of the bill to be inserted and more specifically the positions of the respective movable pieces 30A, 30B are so set as to arrange a movement condition thereof to make the above-mentioned minimum width.

Figure 13:
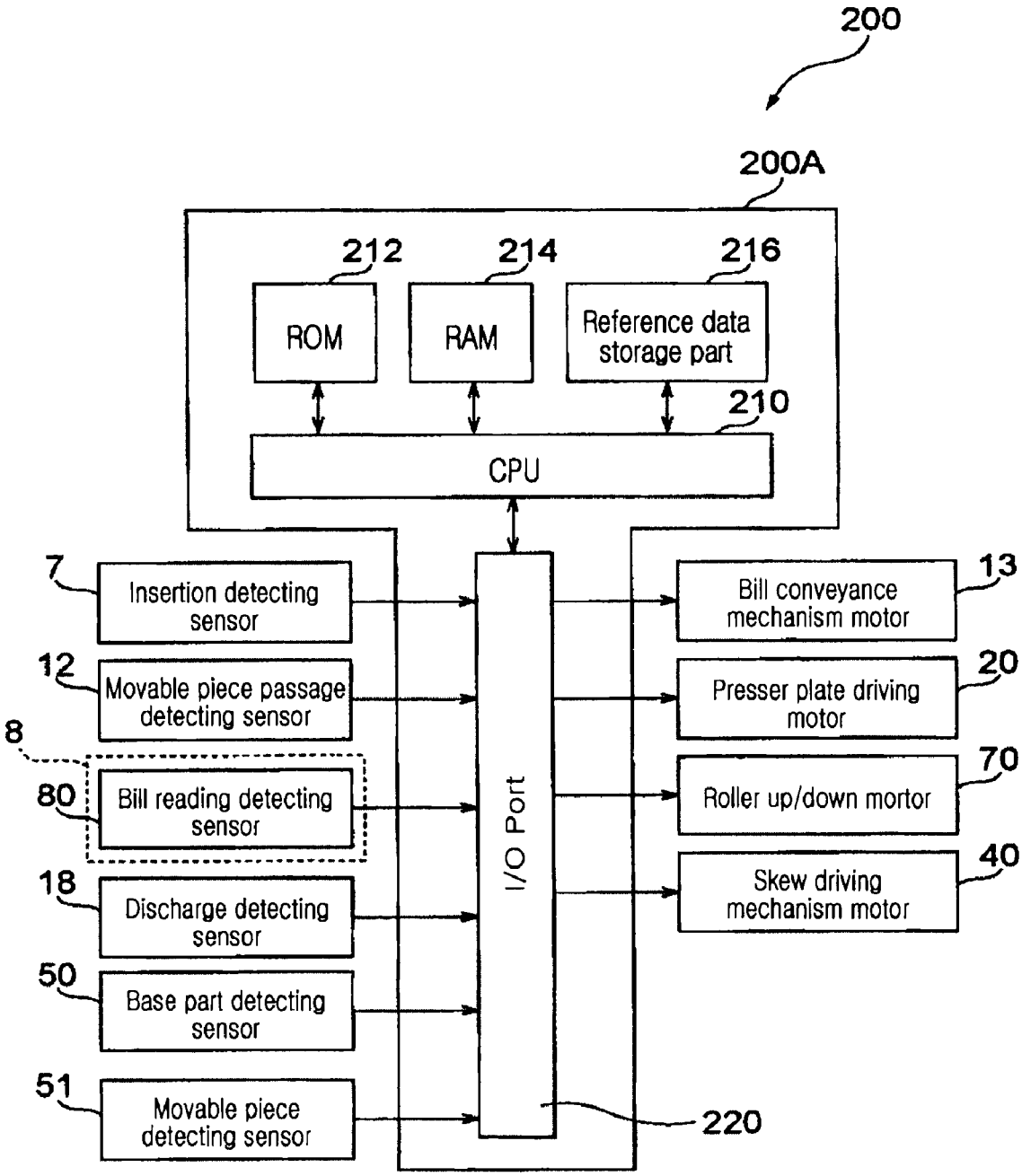
FIG. 13 is a block diagram showing a configuration of control means for controlling drives of a bill conveyance mechanism, bill reading means, and the skew correction mechanism.
Figure 14:
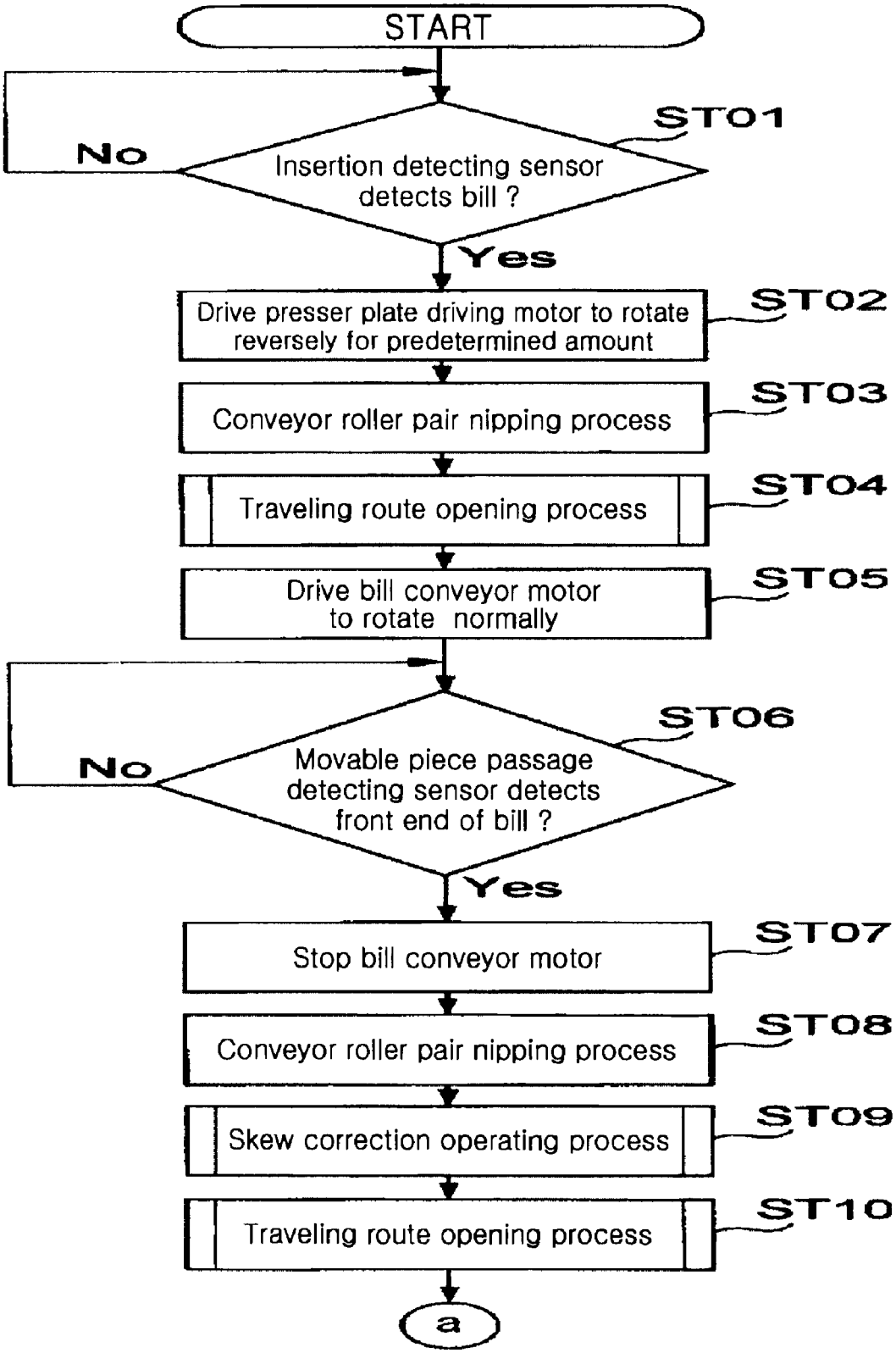
FIG. 14 shows a flowchart (part one) illustrating processing operations for processing the bill with the bill processing apparatus of this embodiment.
Figure 15:
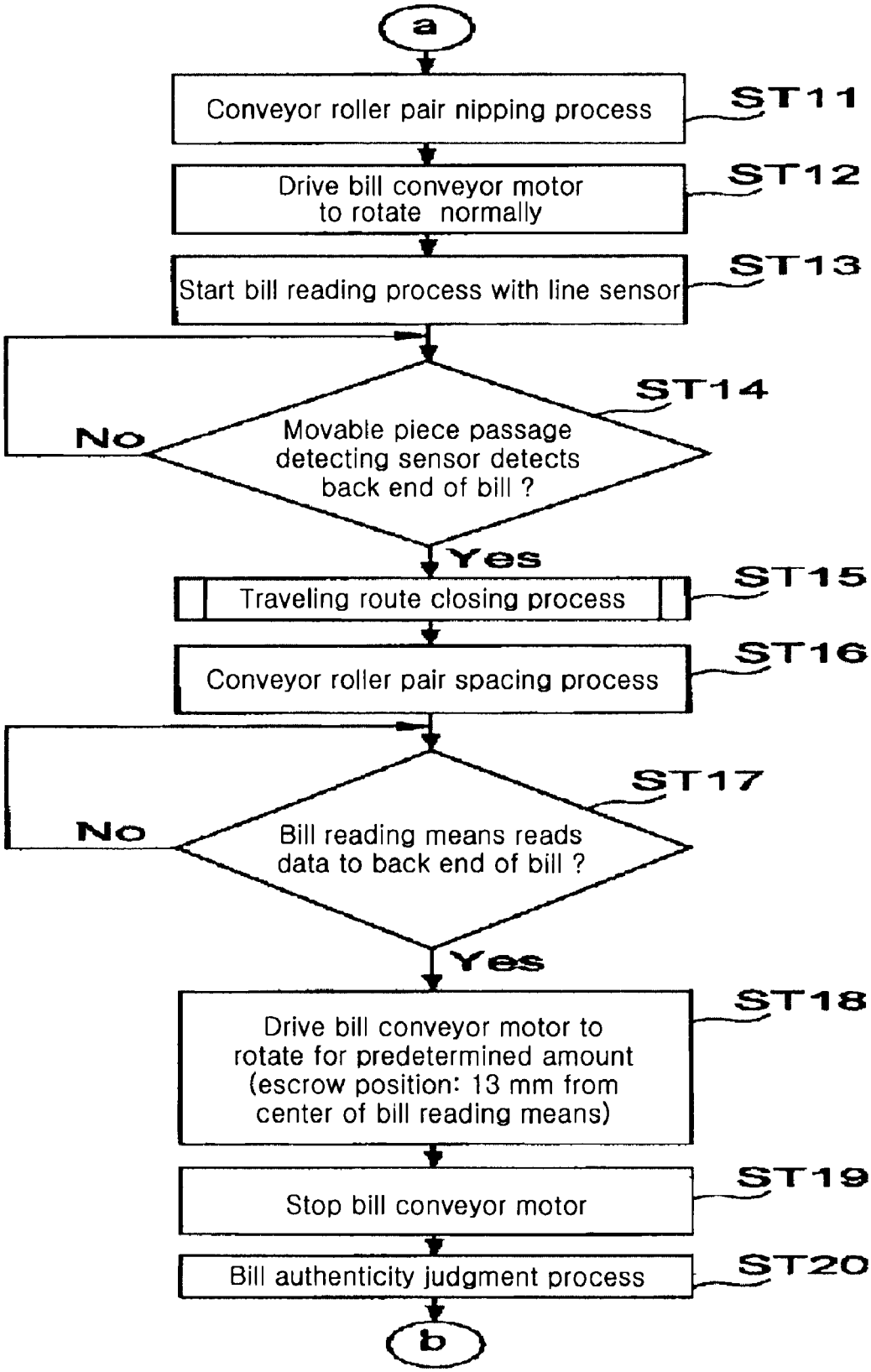
FIG. 15 shows a flowchart (part two) illustrating processing operations for processing the bill with the bill processing apparatus of this embodiment.
Figure 16:
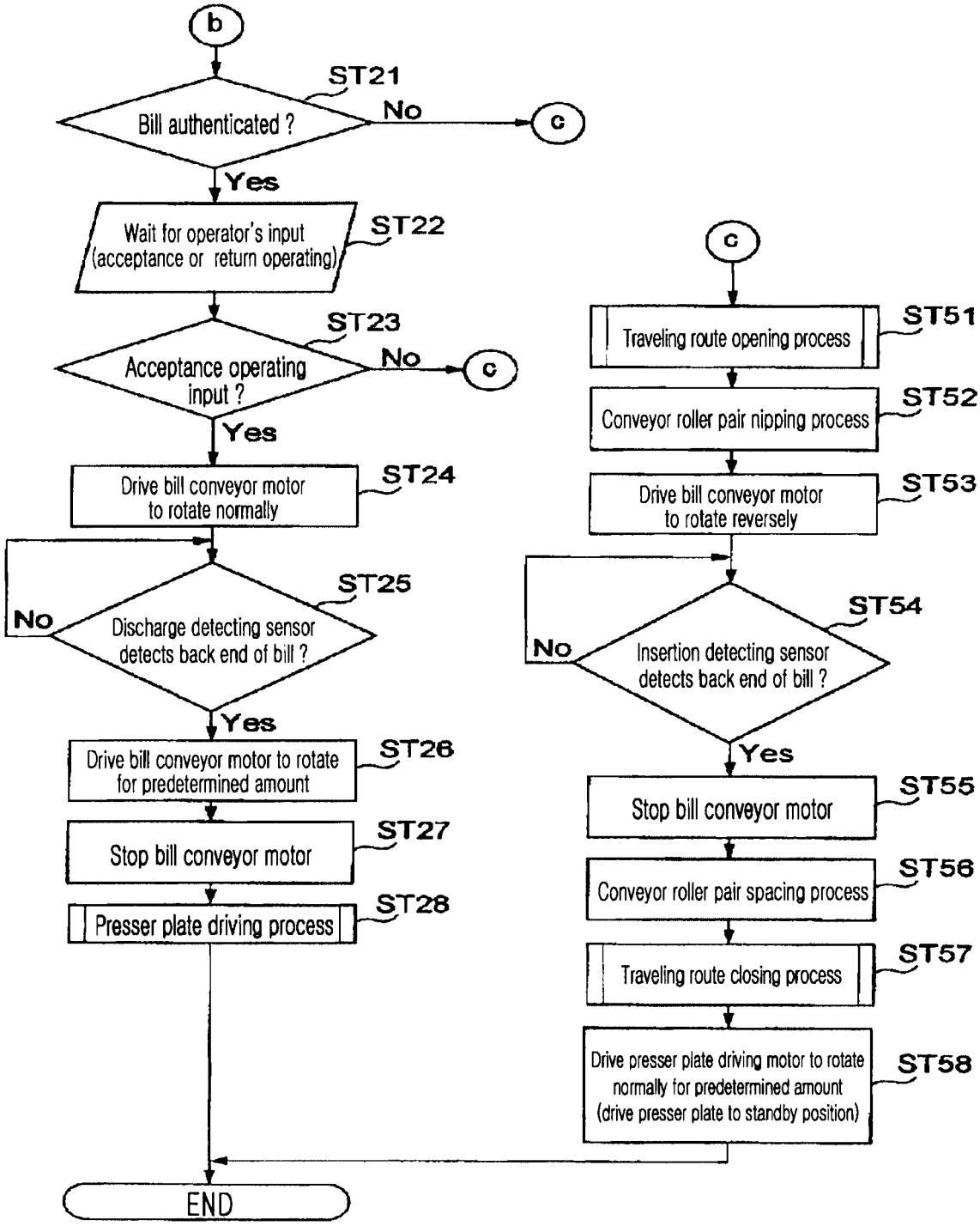
FIG. 16 shows a flowchart (part three) illustrating processing operations for processing the bill in the bill processing apparatus of this embodiment.
Figure 17:
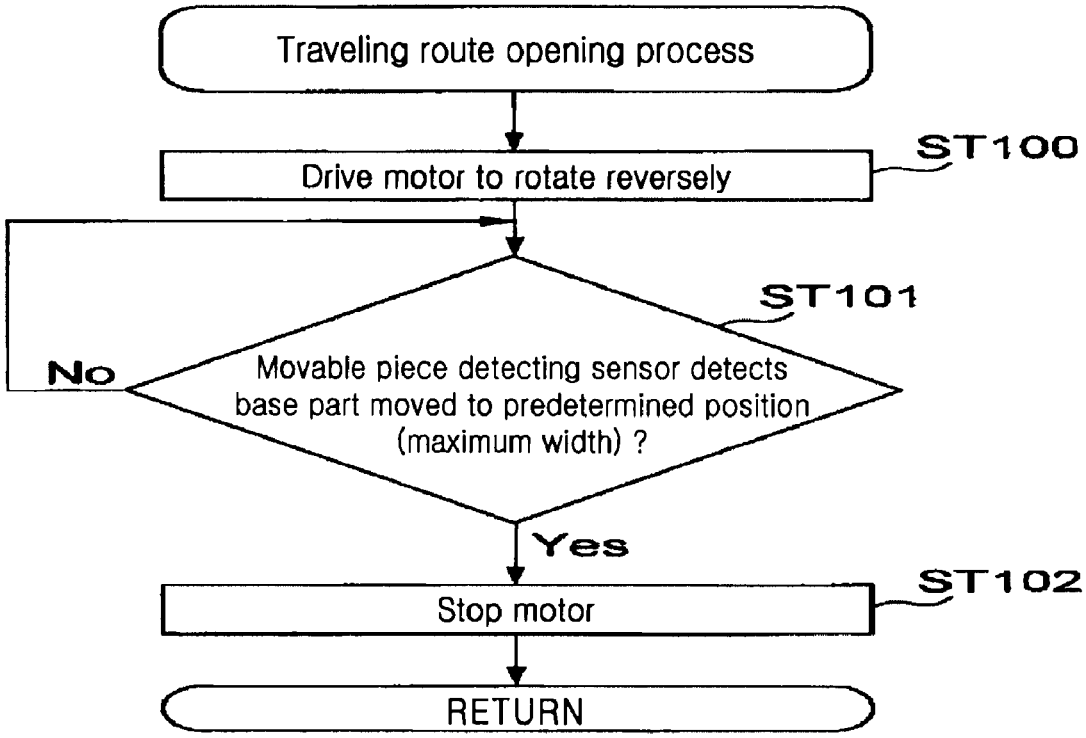
FIG. 17 shows a flowchart illustrating processing operations of a traveling route opening process.

Next, the control means which controls the driving of the bill conveyance mechanism 6, the bill reading means 8, and the skew correction mechanism 10 will be described with reference to FIG. 13.

The control means 200 comprises a control circuit board 200A which controls the operations of the above-described respective drive units, and a CPU (Central Processing Unit) 210 constituting bill identification means, a ROM (Read Only Memory) 212, a RAM (Random Access Memory) 214, and a reference data storage part 216 are implemented on the control circuit board.

In the ROM 212, various types of programs such as an authenticity judgment program for the bill read by the bill reading means 8 and operation programs for the respective drive units such as the motor 13 that drives the above-described bill conveyance mechanism, the motor 20 that drives the presser plate, the roller up-and-down motor 70 that drives the conveyor roller 14A to be contacted with and spaced from the conveyor roller 14B, the motor 40 that drives the base parts in the skew driving mechanism 10, and permanent data are stored such that the CPU 210 generates control signals according to the programs stored in the ROM 212, and carries out input and output of the signals with respect to the respective drive units via an I/O port 220, to control the driving of the respective drive units.

Further, detection signals from the insertion detecting sensor 7, the movable piece passage detecting sensor 12, the discharge detecting sensor 18, the base part detecting sensor 50, and the movable piece detecting sensor 51 are to be input to the CPU 210 via the I/O port 220, and the driving of the respective drive units is controlled on the basis of these detection signals.

Further, data and programs used for the operation of the CPU 210 are stored in the RAM 214, and reference data used for the performance of a bill authenticity judgment, for example, various types of data acquired from all the printing areas of the legitimate bill (such as data about contrasting density and data about transmitted light or reflected light when the bill is irradiated with infrared ray) are stored as reference data in the reference data storage part 216. In addition, the reference data is stored in the dedicated reference data storage part 216. However, the data may be stored in the ROM 212.

Then, a bill reading detection sensor (for example, a line sensor) 80 constituting the above-described bill reading means 8 is connected to the CPU 210 via the I/O port 220, and bill reading data read by the bill reading detection sensor 80 is compared with the reference data stored in the reference data storage part 216 such that a bill authenticity judgment process is executed.

In addition, the control means 200 that controls the operation of the bill processing apparatus is implemented on one control circuit board 200A as mentioned above. However, the control means 200 may be implemented in a distributed manner on separate control circuit boards in accordance with respective functions.

Next, the bill processing operation in the bill processing apparatus 1 executed by the control means will be described with reference to the flowcharts of FIGS. 14 to 19.

When an operator inserts a bill into the bill insertion slot 5, the conveyor roller pair (14A and 14B) installed in the vicinity of the bill insertion slot is in a state that the rollers are spaced from each other in an initial stage (refer to ST16 and ST56 to be described later). Further, with respect to the presser plate 115, as shown in FIGS. 4 and 7, the pair of link members 115*a*, 115*b* driving the presser plate 115 are positioned in the press standby part 108, and the pair of link members 115*a*, 115*b* prevent the bill from being conveyed into the press standby part 108 from the receiving port 103. That is, in this state, the presser plate 115 is brought into the opening formed between the pair of regulatory members 110 such that the opening is in an occluded state so as to prevent the bill stored in the bill housing part from being drawn out.

Moreover, the pair of movable pieces 30A, 30B constituting the skew correction mechanism 10 located on the downstream side of the conveyor roller pair (14A, 14B) are in a state that the pair of movable pieces 10A are moved to leave the minimum open width therebetween (for example, an interval between the pair of movable pieces 30A, 30B is 52 mm; refer to ST15 and ST57 to be described later) so as to prevent the bill from being drawn out in the initial stage.

Figure 20A:
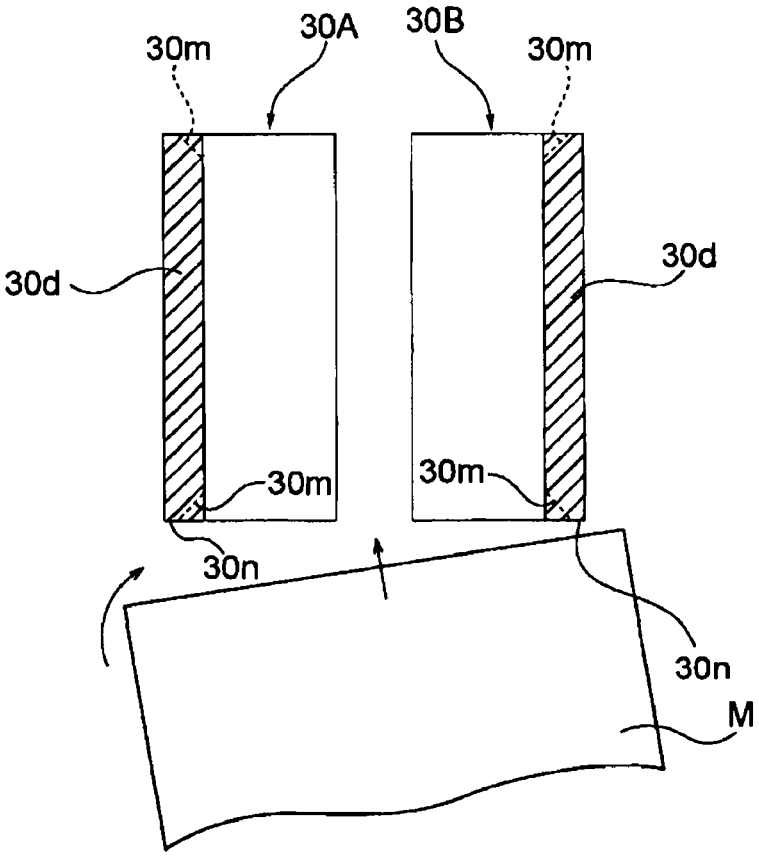
FIG. 20A illustrates a state that an inclined bill having been inserted into a bill insertion slot is contacting a pair of movable pieces.
Figure 20B:
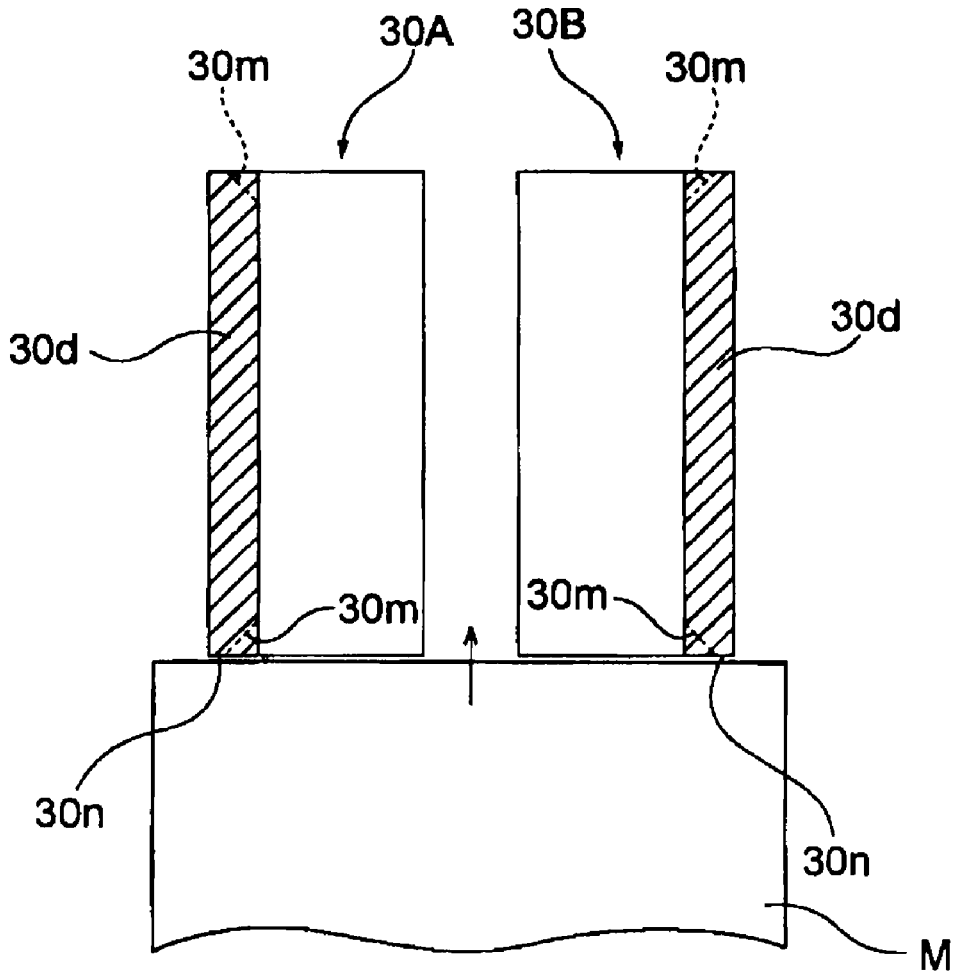
FIG. 20B illustrates a state that the inclination of the bill having been inserted into the bill insertion slot is corrected by the pair of movable pieces.

That is, the pair of movable pieces 30A, 30B is moved to the position where the distance between the pieces is made shorter than the width of the bill (the minimum width positions) by the motor 40 for the skew driving mechanism before the bill having been inserted into the bill insertion slot 5 reaches the movable pieces. Therefore, when a user inserts a bill into the bill insertion slot, the front end edge of the bill contacts the touching faces 30*n* formed on the front end portions of the regulatory walls of the pair of movable pieces 30A, 30B being arranged in a state that an opening between the pieces is narrower than the width of the bill. Therefore, as shown in FIG. 20A, even if the user inserts the bill M in an inclined manner, one side of the leading end edge of the inserted bill contacts one of the touching faces 30*n* so as to make the bill rotate as shown by the arrow, and the inclination is corrected so as to be aligned to the traveling direction as shown in FIG. 20B. Therefore, even if the bill M is inserted into the bill insertion slot 5 in an inclined manner, the bill M is corrected to be aligned to the traveling direction until before the bill M reaches the pair of movable pieces 30A, 30B, whereby bill jamming in this portion is effectively prevented.

As described above, in a paper sheet processing apparatus (e.g., bill processing apparatus 1) which performs a skew correction of a paper sheet (e.g., bill M) to be inserted and conveyed, an insertion slot (e.g., bill insertion slot 5) into which the paper sheet is inserted; a skew correction mechanism 10 which performs a skew correction of the paper sheet having been inserted from the insertion slot; a traveling route (e.g., bill traveling route 3) which extends toward an entrance of the skew correction mechanism from the insertion slot and through which the paper sheet is conveyed; and a conveyance mechanism (e.g., conveyor rollers 14A, 14B) which conveys the paper sheet and is provided between the insertion slot and the entrance of the skew correction mechanism 10 are provided, and the skew correction mechanism 10 comprises a pair of movable pieces 30A, 30B which performs the skew correction of the paper sheet by regulating both side edges of the paper sheet as it is squeezed, and the pair of movable pieces 30A, 30B is so arranged that the pieces are moved to respective positions such that a distance therebetween is shorter than the width of the front end edge of the paper sheet (FIG. 20A) when the front end edge of the paper sheet having been inserted from the insertion slot reaches the entrance of the skew correction mechanism 10. Such pair of movable pieces 30A, 30B respectively comprise regulatory walls 30*b* which regulate both side edges by squeezing the paper sheet; and touching faces 30*n* disposed on end portions thereof on the upstream side from the regulatory walls 30*b*. Further, the touching faces 30*n* of the pair of movable pieces 30A, 30B can have vertical faces substantially perpendicular to the traveling direction and across the traveling route. And the conveyance mechanism conveys the paper sheet such that the front edge of the paper sheet contacts the vertical faces as described above. For example, it is preferable that the respective touching faces 30*n* of the pair of movable pieces 30A, 30B are provided as they are substantially included by the vertical faces. If these touching faces 30*n* are shifted too much in the positions in the traveling direction, it becomes difficult for the front edge of the paper sheet to contact these touching faces 30*n* so as to become substantially perpendicular to the traveling direction. Further, the respective touching faces 30*n* of the pair of movable pieces 30A, 30B, which move close to/apart from each other in a perpendicular direction to the traveling direction, preferably remain in the same position in the traveling direction (corresponding to the distance from the insertion slot) after such movement.

Here, the bottom face of the traveling route 3 is defined by a floor face and the top face is defined by a ceiling face. This ceiling face comprises an inclined face dropping toward the floor face as it goes downstream along the traveling direction (e.g., first inclined guide surface 2*e*). Also, the end portions on the upstream side of the regulatory walls 30*b* of the pair of movable pieces 30A, 30B have inclined faces 30*m* as the distance between the regulatory walls 30*b* of the pair of movable pieces 30A, 30B is widened in the downstream direction in the traveling direction.

As described above, in the initial state of the pair of conveyor rollers (14A and 14B), the operator can easily insert a bill, even if it is wrinkled, into the bill insertion slot 5 since both conveyor rollers are spaced apart. Then, when the insertion detecting sensor 7 detects the insertion of the bill (ST01), the driving motor 20 of the above-described presser plate 115 is driven to rotate reversely for a predetermined amount (ST02) to move the presser plate 115 from the standby position to the initial position. That is, the presser plate 115 is in a state that the presser plate 115 is moved and remains in the opening such that it is so arranged that the bill cannot pass through the opening until the insertion of a bill is detected by the insertion detecting sensor 7.

When the presser plate 115 is moved to the initial position, the press waiting part 108 becomes in an open state (refer to FIG. 7) such that the apparatus is in a state that the bill can be conveyed into the bill housing part 100. That is, by driving the motor 20 to rotate reversely for a predetermined amount, the presser plate 115 is moved from the standby position to the initial position via the main body side gear train 21 and the presser plate driving mechanism 120 (the housing part side gear train 124, the rack formed on the movable member 122, and the link members 115*a*, 115*b*).

Further, the above-described roller up-and-down motor 70 is driven to move the upper conveyor roller 14A so as to make a contact with the lower conveyor roller 14B. In accordance therewith, the inserted bill is nipped and held therebetween by the pair of conveyor rollers (14A and 14B) (ST03).

Next, a traveling route opening process is conducted (ST04). The opening process is conducted by driving the pair of movable pieces 30A, 30B to move in separating directions so as to become apart with each other as the motor 40 for the skew correction mechanism is driven to rotate reversely as shown in the flow chart of FIG. 17 (ST100). At this time, when it is detected that the pair of movable pieces 30A, 30B have moved to the predetermined positions (the maximum open width positions) by the base part detecting sensor 50 that detects positions of the pair of movable pieces 30A, 30B (ST101), the driving operation to rotate the motor 40 reversely is stopped (ST102). This traveling route opening process allows the bill to enter between the pair of movable pieces 30A, 30B. In addition, in the previous step of ST04, the bill traveling route 3 is in a closed state by a traveling route closing process (ST15, ST57) to be described later. Thus, the bill traveling route 3 is closed in this way before an insertion of the bill so as to prevent an element such as a line sensor from being broken by, for example, inserting a plate-like member from the bill insertion slot for illicit purposes or the like.

Next, the bill conveyor motor 13 is driven to rotate normally (ST05). The bill is carried into the inside of the apparatus by the conveyor roller pair (14A and 14B), and when the movable piece passage detecting sensor 12 installed on the downstream side from the skew correction mechanism 10 detects the front end of the bill, the bill conveyor motor 13 is stopped (ST06 and ST07). At this time, the bill is located between the pair of movable pieces 30A, 30B constituting the skew correction mechanism 10.

Next, the above-described roller un-and-down motor 70 is driven to allow the conveyor roller pair (14A and 14B) holding the bill therebetween to become apart from each other (ST08). At this time, the bill is in a state that no load is applied.

Figure 18:
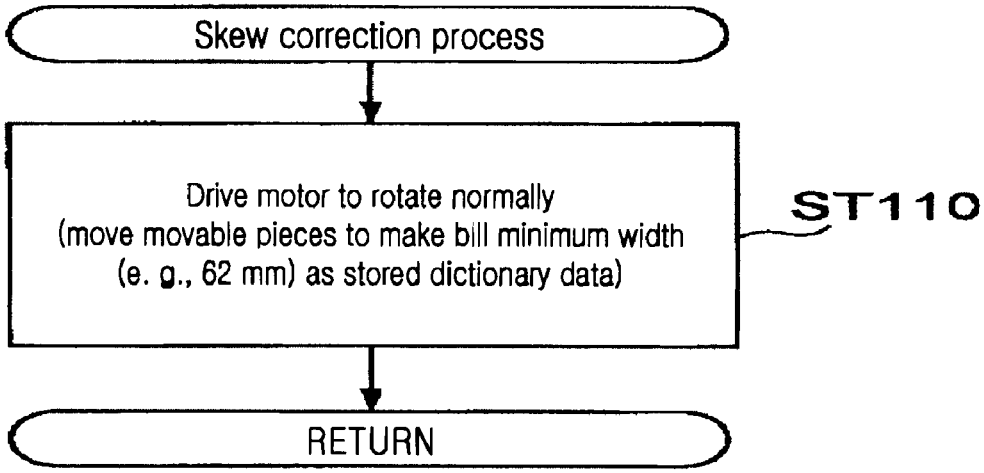
FIG. 18 shows a flowchart illustrating processing operations of a skew correction process.
Figure 21:
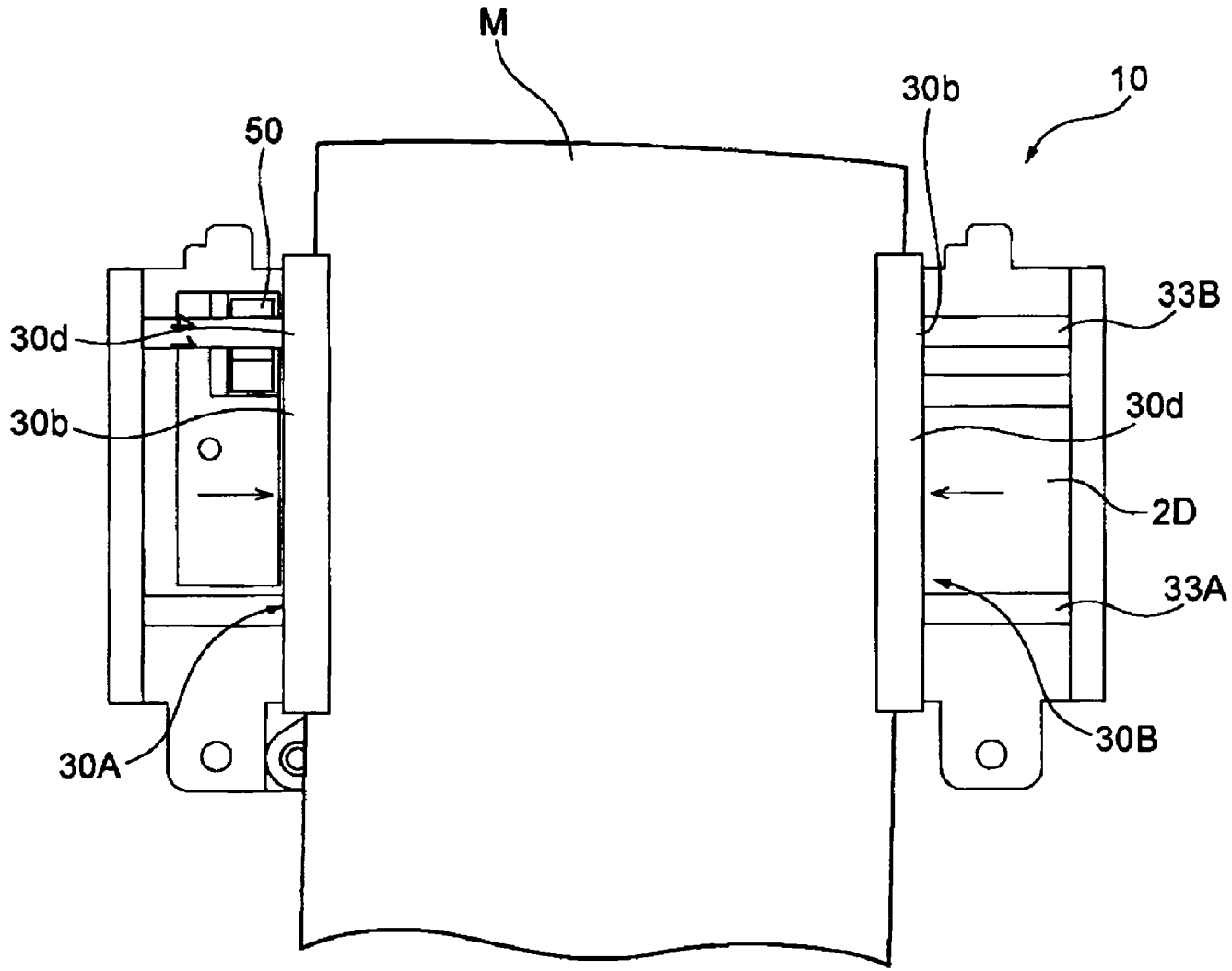
FIG. 21 is a plan view of the skew correction mechanism showing a state that the pair of movable pieces touch both side edges of the bill.

Then, a skew correction operating process is executed as the bill remains in this state (ST09). The skew correction operating process is conducted by driving the motor 40 for the skew correction mechanism to rotate normally to drive the pair of movable pieces 30A, 30B to get closer with each other. That is, in this skew correction operating process, as shown in the flowchart of FIG. 18, the motor 40 described above is driven to rotate normally to move the pair of movable pieces 30A, 30B in respective directions such that the pair of movable pieces 30A, 30B get closer with each other (ST110). The movement of the movable pieces is continued until the distance therebetween becomes the minimum width (for example; width of 62 mm) of the bill registered in the reference data storage part in the control means. FIG. 21 shows a state that the pair of movable pieces 30A, 30B move in the arrow directions by the movement of the pair of base parts 31A, 31B to get closer to each other such that the movable pieces contact both side edges of the bill M.

Figure 22:
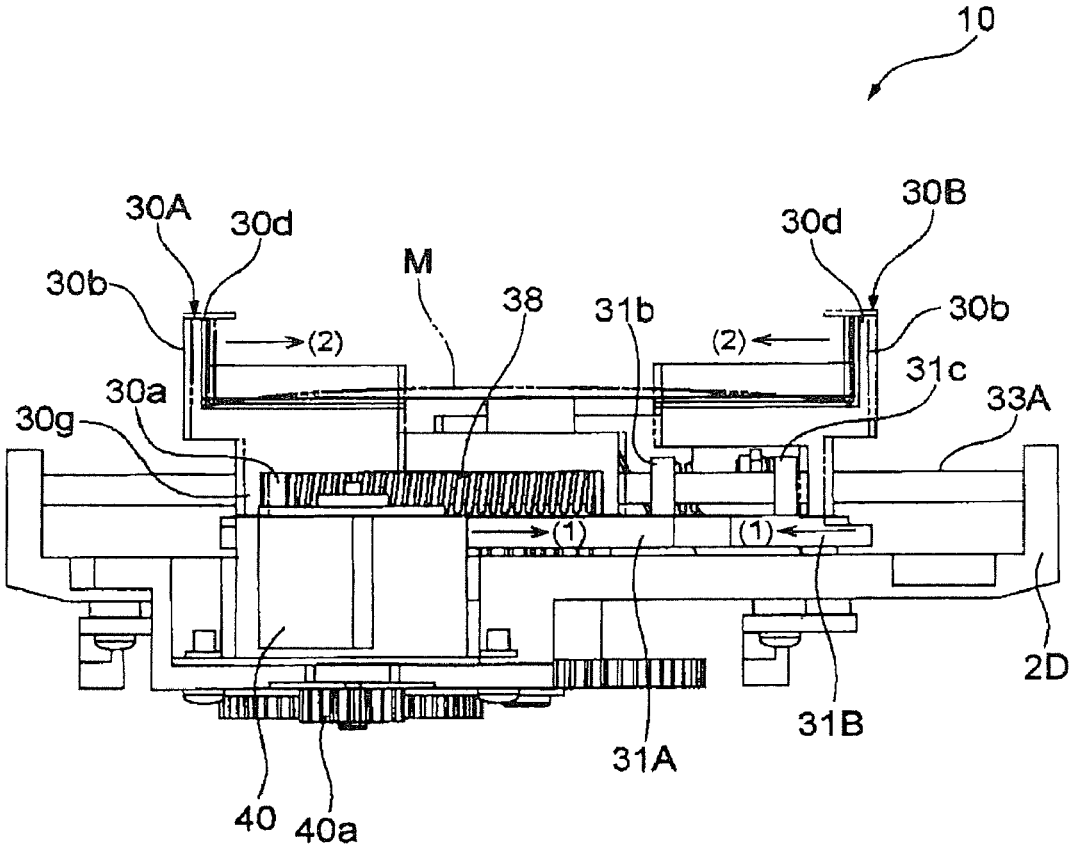
FIG. 22 is a front view of the skew correction mechanism viewed from the bill insertion slot side so as to illustrate a state that the skew is eliminated.

The skew correction process for the bill at this time will be described with reference to FIGS. 21 and 22.

Before the skew correction process is performed, the bill is located between the movable pieces 30A and 30B, which are positioned to the right side and the left side, respectively. In this state, by driving the above-described motor 40 to rotate normally, the pair of base parts 31A and 31B move in the directions to get closer to each other (directions indicated by arrows (1)). At this time, the pair of movable pieces 30A and 30B are moved toward the center of the bill traveling route (directions indicated by arrows (2)) in an integrated fashion by the biasing force of the spring 38 interposed between the base parts 31A and 31B. Then, the regulatory walls 30*b* of the movable pieces 30A, 30B respectively hit (or touch) the side edges of the bill by the movement of the base parts 31A, 31B. In accordance therewith, the base parts 31A and 31B further move toward the center of the bill traveling route (directions of arrows (1)) with respect to the movable pieces 30A and 30B against the biasing force of the spring 38 although load caused by the reactive force of the bill is applied to the motor 40.

At this time, the bill is moved toward the center so as to be aligned by the movable pieces 30A and 30B which hit both sides of the bill and the skew of the bill is corrected as well as the bill is positioned on the accurate center position. As described above, since the movement of the pair of base parts 31A and 31B is continued until the pair of movable pieces 30A and 30B are moved to make the minimum width of the bill registered with the reference data storage part in the control means, the skew thereof is corrected by the pair of movable pieces and the bill is positioned accurately in the center position although there is a possibility that the bill is curved so as to curl up in its center region as shown by a dotted line M of FIG. 22.

In addition, as described above, provided that the biasing force of the spring 38 is set to be less than the reactive force of the bill to be carried between the movable pieces 30A and 30B (reactive force generated when the bill is curved due to the pair of movable pieces hitting the side edges of the bill), and an extent that the bill can be moved toward the center of the bill traveling route, the possibility that the bill is bent by the movable pieces 30A, 30B is reduced, and the bill can be moved toward the center (moved so as to be positioned in the center). That is, the extent that the bill is curved as described above is reduced, and the possibility that the bill is bent or the ends of the bill are damaged is reduced.

Further, in the above-described configuration, the touching areas of the bill with respect to the movable pieces 30A, 30B are inner face portions of the plate-like regulatory walls 30*b*. In this way, the contacts of the movable pieces 30A, 30B with respect to the side edges of the bill are made on the plate-like regulatory wall portions, and additionally, the inclined faces 30*m* are formed on the front and back end potions of the movable pieces as shown in FIG. 8. Therefore, it is possible to effectively prevent that the bill in a state that the bill is touching the end portions of the both regulatory walls 30*b* when the pair of movable pieces 30A, 30B are moved to open in order to perform the skew correction.

And, in this embodiment, since the ceiling plates 30*d* are formed on the top ends of the regulatory walls 30*b*, it is prevented that the bill goes over the regulatory walls 30*b* of the movable pieces 30A, 30B when the correction processing of the skew is performed, whereby it would be possible to reliably align the bill to the center of the bill traveling route.

When the skew correction operating process as described above is completed, a traveling route opening process is subsequently executed (ST10). This process is conducted by moving the pair of movable pieces 30A, 30B in separating directions as the above-described motor 40 for the skew correct ion mechanism is driven to rotate reversely (refer to ST100 to ST102 of FIG. 17).

Next, the above-described roller up-and-down motor 70 is driven to move the upper conveyor roller 14A to contact the lower conveyor roller 14B, and the bill is nipped and held between the pair of conveyor rollers (14A and 14B) (ST11). Thereafter, the bill conveyor motor 13 is driven to rotate normally to carry the bill into the inside of the apparatus, and when the bill passes through the bill reading means 8, a bill reading process is executed (ST12 and ST13).

Figure 19:
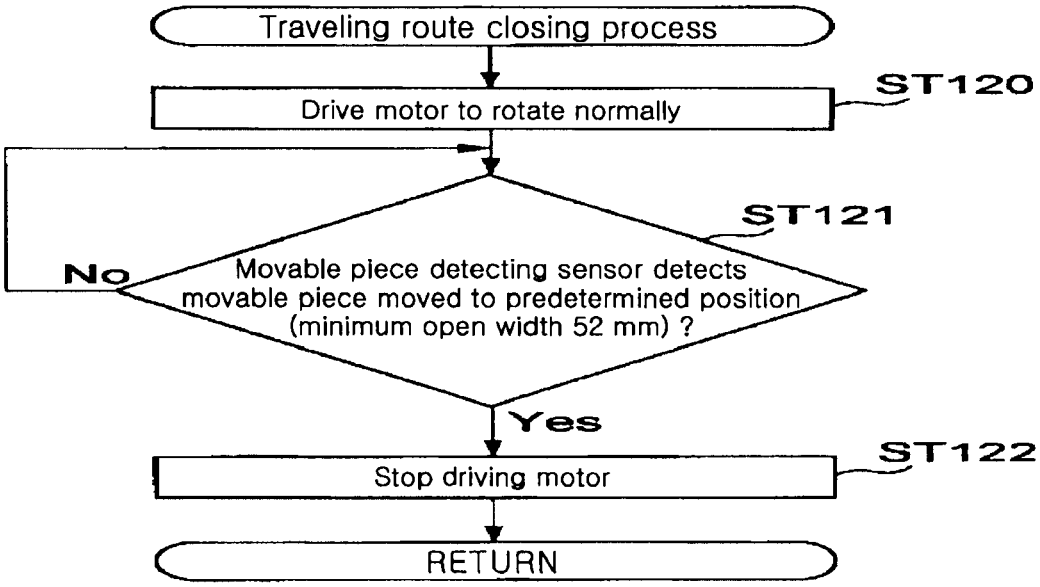
FIG. 19 shows a flowchart illustrating processing operations of a traveling route closing process.

Then, when the bill to be carried passes through the bill reading means 8, and the back end of the bill is detected by the movable piece detecting sensor 12 (ST14), a process for closing the bill traveling route 3 is executed (ST15). In this process, first, as shown in the flowchart of FIG. 19, after the back end of the bill is detected by the movable piece detecting sensor 12, the above-described motor 40 is driven to rotate normally to move the pair of movable pieces 30A, 30B in respective directions such that the pair of movable pieces 30A, 30B get closer to each other (ST120). Next, when it is detected by the movable piece detecting sensor 51 that the movable pieces 30A, 30B move to the predetermined positions (minimum open width positions: for example, width of 52 mm) (ST121), the driving operation of the normal rotation of the motor 40 is stopped (ST122).

With this traveling route closing process, the pair of movable pieces 30A, 30B are moved to the minimum open width positions (width of 52 mm) narrower than the width of any bill allowed to be inserted, thereby effectively preventing the bill from being drawn out. That is, by executing such a bill traveling route closing process, an opening distance between the movable pieces 30A, 30B is made shorter than the width of the inserted bill, thereby enabling the effective prevention of an action of drawing-out the bill in the direction toward the insertion slot by the operator for illicit purposes.

Further, as described above, the movable piece detecting sensor 51 as shown in FIGS. 11 and 12A is configured to detect a position where the movable piece 30B becomes closest to the center of the bill traveling route (positions where the movable pieces are moved to make the minimum width; predetermined position), and to detect the movement when the movable piece 30B moves in the spacing direction.

In this case, when the movable piece detecting sensor 51 detects a movement of the movable piece, it may be adjudged that an operator is committing some fraudulent activity, and the predetermined processes may be executed. For example, a fraudulent manipulated signal (an anomaly sensed signal) may be transmitted to a higher-level apparatus that manages the operations of the bill processing apparatus, or an annunciator lamp may be provided on the bill processing apparatus, and this lamp may blink, or without activating a process for input acceptance (ST22) input by another operator thereafter, a process in which a discharge operation or the like is forcibly carried out may be executed. Or, appropriate processes such as canceling the operation of the bill processing apparatus (for example, a process for stopping the processing, a process for discharging the bill, and the like) and the like may be executed.

Further, in succession to the traveling route closing process described above (ST15), a conveyor roller pair spacing process is executed such that the above-mentioned roller up-and-down motor 70 is driven to make the conveyor roller pair (14A, 14B) having been in a state capable of nipping and holding the bill therebetween separate from each other (ST16). By executing the conveyor roller pair spacing process, even if the operator additionally inserts (double insertion) another bill by mistake, the bill is not subject to a feeding operation by the conveyor roller pair (14A, 14B) and hits touching faces 30*n* of the pair of movable pieces 30A, 30B in a closed state according to ST15 such that it is possible to reliably prevent the operation of bill double-insertion.

Along with the bill traveling route closing process as mentioned above, when the bill reading means 8 reads the data up to the back end of the bill, the bill conveyor motor 13 is driven for a predetermined amount and leave the bill stopped at a predetermined position (escrow position; position where the bill is carried toward the downstream by 13 mm from the center position of the bill reading means 8), and at this time, a bill authenticity judgment process is executed by the control means 200 (ST17 to ST20).

In the bill authenticity judgment process at ST20 as described above, when the bill is judged as a legitimate bill (ST21; Yes), an input from the operator is received (ST22). This input corresponds to an acceptance operation in which the operator presses an acceptance button in order to accept provision of services (for example, in the case of a gaming device, an acceptance process accompanied by start of a game), and a return operation in which the operator presses a return button in order to execute a process for returning the inserted bill.

Then, when an operation to accept the provision of various types of services is input (ST23; Yes), the bill conveyor motor 13 is consecutively driven to rotate normally to convey the bill in this state toward the bill housing part 100 (ST24). While the bill is conveyed, the bill conveyor motor 13 is driven to rotate normally until the back end of the bill is detected by the discharge detecting sensor 18, and after the back end of the bill is detected by the discharge detecting sensor 18 (ST25), the bill conveyor motor 13 is driven to rotate normally by the predetermined amount (ST26 and ST27).

The process for driving the bill conveyor motor 13 to rotate normally in ST26 and ST27 corresponds to a driving amount for which the bill is conveyed in the receiving port 103 of the bill housing part 100 from the discharge slot 3*a* on the downstream side of the bill traveling route 3 of the apparatus main body 2 so that the pair of belts 150 contact the surface on both sides of the conveyed-in bill to guide the bill stably to the press standby part 108. That is, by further driving the bill conveyor motor 13 to rotate normally for a predetermined amount after the back end of the bill is detected by the discharge detecting sensor 18, the pair of belts 150 contact the bill conveyed-in and are driven in the bill feeding direction so as to guide the bill in a stable state to the press standby part 108.

Then, after the above-described bill conveyor motor 13 is stopped, the process for driving the presser plate 115 is executed (ST28) such that the bill is placed on the placing plate 105. And, after the pressing process is completed, the presser plate 115 is again moved to the standby position and stopped to the position.

Further, in the above-mentioned process of ST21, when the bill is judged as a non-legitimate bill (ST21; No) or the operator presses the return button (ST23; No), a traveling route opening process is executed (ST51, refer to ST100 to ST102 of FIG. 17). After that, the bill conveyor motor 13 is driven to rotate reversely and the conveyor roller pair (14A, 14B) are brought in contact with each other such that the bill waiting at the escrow position is conveyed toward the bill insertion slot 5 (ST52 and ST53). Then, when the insertion detecting sensor 7 senses the back end of the bill to be returned toward the bill insertion slot 5, the driving to reversely rotate the bill conveyor motor 13 is stopped, and above-described roller up-and-down motor 70 is driven to make the conveyor roller pair (14A and 14B) in a state of nipping and holding the bill therebetween separate from each other (ST54 to ST56). After that, the traveling route closing process is executed (refer to ST57, and ST120 to ST122 in FIG. 19) and the driving motor 20 for the presser plate 115 is driven to rotate normally (ST58) such that the presser plate 115 positioned at the initial position is driven to move to the standby position, and then a series of processes are completed.

According to the bill processing apparatus having the above-described configuration, when a user inserts a bill into the bill insertion slot 5, the front end edge of the bill contacts the touching faces 30*n* of the pair of movable pieces 30A, 30B. Therefore, even if the user inserts the bill in an inclined manner, the inclination is corrected so as to be aligned to the traveling direction by the pair of movable pieces, and the bill is prevented from getting jammed before the bill reaches the pair of movable pieces 30A, 30B.

As mentioned above, the embodiment of the present invention is described. However, the present invention is not limited to the above-described embodiment, and various modifications of the present invention can be implemented. In the present invention, it suffices for the pair of movable pieces to be in a state that the movable pieces have been moved to the positions where a distance between the movable pieces is narrower than a width of the bill when a bill is inserted into the bill insertion slot 5. The driving source that drives such movable pieces or the power transmission mechanism from the driving source may be appropriately modified. Further, it suffices for the distance (width) between the pair of movable pieces to be narrower than the width of the bill to be inserted.

According to the paper sheet processing apparatus of this embodiment, when a user inserts a paper sheet into an insertion slot, a front end edge of the paper sheet contacts the pair of movable pieces in a state that a distance between a pair of movable pieces is narrower than the width of the paper sheet. Therefore, even if the user inserts the paper sheet in an inclined manner, its inclination is corrected so as to be aligned to the traveling direction by the pair of movable pieces. Therefore, even if a paper sheet is inserted in an inclined manner into the insertion slot, the paper sheet is prevented from getting jammed before the paper sheet reaches the pair of movable pieces.

Further, the pair of movable pieces have regulatory walls that regulate the side edges of an inserted paper sheet to correct its inclination, and the regulatory wall is formed so as to make its width narrower as it approaches the end.

In the above-described configuration, since the pair of movable pieces have regulatory walls that regulate the side edges of a paper sheet to correct its inclination, and the regulatory walls are formed so as to make its width narrower as it approaches the end, when the pair of movable pieces moves so as to be opened in order to perform skew correction, the paper sheet to touch the ends of the regulatory walls is prevented from being damaged.

As described above, a paper sheet processing apparatus capable of effectively preventing a paper sheet from being jammed by correcting its inclination to the traveling direction when the paper sheet is inserted into an insertion slot can be provided.

The present invention can be applied not only to the bill processing apparatus, but also to a device which provides products and services when the paper sheet such as a service ticket and a coupon ticket, for example, is inserted.

What is claimed is:

1. A paper sheet processing apparatus which performs a skew correction of a paper sheet inserted and conveyed, comprising:

an insertion slot into which the paper sheet is inserted;

a skew correction mechanism which performs the skew correction of the paper sheet inserted from the insertion slot;

a traveling route which extends from the insertion slot to an entrance of the skew correction mechanism and through which the paper sheet is conveyed;

a conveyance mechanism which conveys the paper sheet provided between the insertion slot and the entrance of the skew correction mechanism, wherein:

the skew correction mechanism comprises a pair of movable pieces which performs the skew correction of the paper sheet by regulating both side edges thereof as the paper sheet is squeezed, and the pair of movable pieces are positioned such that an open width between the pair of movable pieces is narrower than a width of a front end edge of the paper sheet when the front end edge of the paper sheet inserted from the insertion slot reaches the entrance of the skew correction mechanism, wherein:

the pair of movable pieces respectively comprise:

regulatory walls to regulate both side edges thereof as the paper sheet is squeezed; and touching faces at end portions of the regulatory walls on an upstream side, the touching faces of the pair of movable pieces are formed across the traveling route and define a vertical face substantially perpendicular to the traveling direction, and the conveyance mechanism conveys the paper sheet such that a front end edge of the paper sheet contacts the vertical face.

2. The paper sheet processing apparatus according to claim 1, wherein the end portions on the upstream side of the regulatory walls of the pair of movable pieces comprise inclined surfaces such that a distance between the regulatory walls of the pair of movable pieces is widen in a downstream direction along the traveling direction.

3. The paper sheet processing apparatus according to claim 2, wherein the conveyor mechanism comprises a pair of rollers to rotate such that the paper sheet is nipped on top and bottom faces and conveyed in the traveling direction, and wherein the pair of rollers is provided in a center portion in a lateral direction of the traveling route.

4. The paper sheet processing apparatus according to claim 1, wherein the conveyor mechanism comprises a pair of rollers to rotate such that the paper sheet is nipped on top and bottom faces and conveyed in the traveling direction, and wherein the pair of rollers is provided in a center portion in a lateral direction of the traveling route.

5. The paper sheet processing apparatus according to claim 1, comprising:

a floor face defining a bottom face of the traveling route; and a ceiling face defining a top face of the traveling route, wherein the ceiling face comprises an inclined face dropping toward the floor face in a downstream direction along the traveling direction.

6. The paper sheet processing apparatus according to claim 5, wherein the conveyor mechanism comprises a pair of rollers to rotate such that the paper sheet is nipped on top and bottom faces and conveyed in the traveling direction, and wherein the pair of rollers is provided in a center portion in a lateral direction of the traveling route.

* * * * *